US009702384B2

(12) United States Patent
Akagi et al.

(10) Patent No.: US 9,702,384 B2
(45) Date of Patent: Jul. 11, 2017

(54) FLUID TRANSPORTATION DEVICE AND FLUID TRANSPORTATION METHOD

(71) Applicants: Fujio Akagi, Minami-ku, Fukuoka (JP); Isao Haraga, Jonan-ku, Fukuoka (JP)

(72) Inventors: Fujio Akagi, Fukuoka (JP); Isao Haraga, Fukuoka (JP); Sumio Yamaguchi, Fukuoka (JP); Yoichi Ando, Fukuoka (JP); Kazuo Higa, Fukuoka (JP)

( * ) Notice: Subject to any disclaimer, the term of this patent is extended or adjusted under 35 U.S.C. 154(b) by 0 days.

(21) Appl. No.: 14/605,381

(22) Filed: Jan. 26, 2015

(65) Prior Publication Data

US 2015/0300385 A1 Oct. 22, 2015

Related U.S. Application Data

(63) Continuation of application No. PCT/JP2013/066321, filed on Jun. 13, 2013.

(30) Foreign Application Priority Data

Jul. 24, 2012 (JP) ..... 2012-163897

(51) Int. Cl.
*F15C 1/16* (2006.01)
*F15D 1/00* (2006.01)
*F24F 13/06* (2006.01)

(52) U.S. Cl.
CPC ..... *F15D 1/009* (2013.01); *F24F 13/06* (2013.01); *F24F 2013/0612* (2013.01)

(58) Field of Classification Search
CPC ... F15D 1/009; F24F 13/06; F24F 2013/0612; Y10T 137/2087; Y10T 137/2093; Y10T 137/2098

(Continued)

(56) References Cited

U.S. PATENT DOCUMENTS 2,910,830 A * 11/1959 White ..... F02C 7/04 137/810
3,186,329 A * 6/1965 Kennedy ..... F24F 13/06 454/316

(Continued)

FOREIGN PATENT DOCUMENTS

JP 63-150500 6/1988
JP 63-163000 10/1988

(Continued)

OTHER PUBLICATIONS

English language translation of the International Preliminary Report on Patentability for PCT/JP2013/066321, downloaded from the WIPO website on Jun. 18, 2015, 5 pages.

(Continued)

*Primary Examiner* — Mary McManmon
*Assistant Examiner* — Minh Le
(74) *Attorney, Agent, or Firm* — Staas & Halsey LLP

(57) ABSTRACT

Provided is a fluid transportation device and a fluid transportation method in which a transported fluid such as a gas or a liquid can be ejected into a space from an ejection unit and transported locally to a target location distant from the ejection unit while minimizing scattering. The transporting fluid is ejected from an ejection port into a space and thereby forms vortex rings, and the transported fluid is fed to the outside of the transporting fluid at a speed that is lower than that at the center of the transporting fluid, whereby the transported fluid is directly accommodated in the vortex rings formed by the transporting fluid moving in a rolling motion at the ejection port, and transported together with the vortex rings.

16 Claims, 19 Drawing Sheets

(58) Field of Classification Search
USPC ..... 137/808, 809, 810, 13, 811, 812
See application file for complete search history.

(56) References Cited

U.S. PATENT DOCUMENTS

| | | | | |
|---|---|---|---|---|
| 3,229,461 | A * | 1/1966 | Jones | F02K 9/82 137/808 |
| 3,396,738 | A * | 8/1968 | Gunnar | F04D 29/681 137/13 |
| 5,188,868 | A * | 2/1993 | Horii | B01J 2/006 118/303 |
| 6,854,260 | B2 * | 2/2005 | Anderson | F02K 1/46 181/213 |
| 7,243,678 | B2 * | 7/2007 | Banerjee | B60K 15/04 137/587 |
| 8,807,458 | B2 * | 8/2014 | Al-Ansary | B05B 7/0416 137/808 |
| 2008/0264505 | A1 * | 10/2008 | Matsuo | B60H 1/34 137/808 |
| 2011/0039491 | A1 * | 2/2011 | Khalifa | F24F 13/04 454/305 |
| 2012/0085124 | A1 | 4/2012 | Maruyama et al. | |
| 2012/0160357 | A1 * | 6/2012 | Weis | F15D 1/08 137/808 |
| 2012/0273297 | A1 * | 11/2012 | Schlosser | F01N 1/026 181/213 |
| 2013/0068332 | A1 * | 3/2013 | Zhang | E02B 9/06 137/808 |
| 2013/0214054 | A1 * | 8/2013 | Faulkner | B05B 5/032 239/3 |
| 2015/0129040 | A1 * | 5/2015 | Hartig | B63J 2/02 137/1 |

FOREIGN PATENT DOCUMENTS

| | | |
|---|---|---|
| JP | 2000-176339 | 6/2000 |
| JP | 2005-16412 | 1/2005 |
| JP | 2009-186127 | 8/2009 |
| JP | 2012-97733 | 5/2012 |
| JP | 2012-163897 | 7/2012 |
| WO | PCT/JP2013/066321 | 6/2013 |

OTHER PUBLICATIONS

Fujio Akagi et al., "The Influence of Formation Conditions on the Axi-symmetry Characteristics of Cyclic Vortex Rings Behavior," Proceedings of the 6th International Conference on Vortex Flows and Vortex Models, Nov. 17-20, 2014, 6 pages.

Fujio Akagi, "Maximum Circulation of a Vortex Ring Generated by a Pulsating Jet," 4th International Conference on Jets, Wakes and Separated Flows, Sep. 17-21, 2013, 6 pages.

Fujio Akagi et al., "Circulation of a Vortex Ring Generated by Pulsating Jet Flow," Proceedings of ASME-JEME-KSME Joint Fluids Engineering Conference 2011, Jul. 24-29, 2011, 10 pages.

English Language International Search Report for PCT/JP2013/066321, mailed Sep. 24, 2013, 4 pages.

* cited by examiner

【Fig.1】
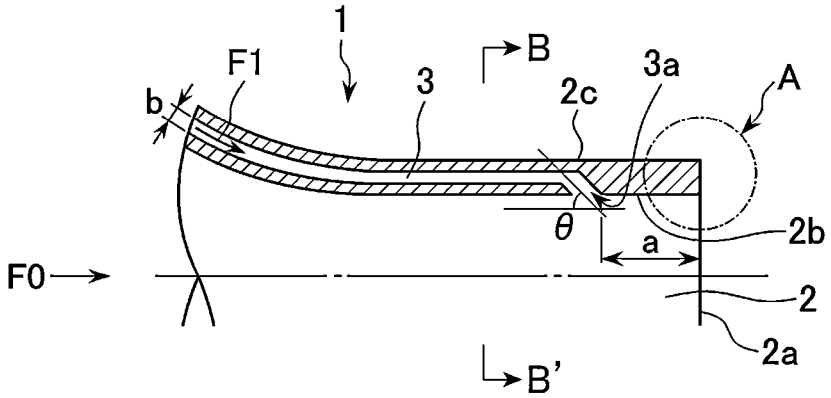
【Fig.2】
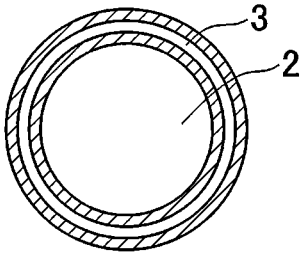

【Fig.3A】
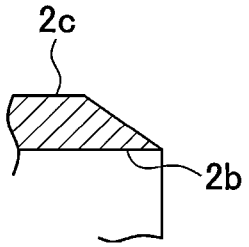
【Fig.3B】
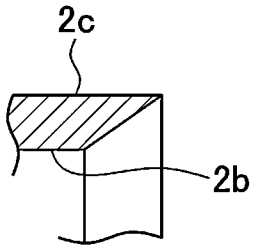

【Fig.4A】
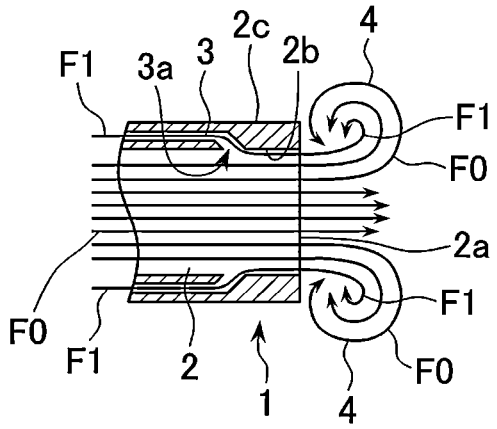
【Fig.4B】
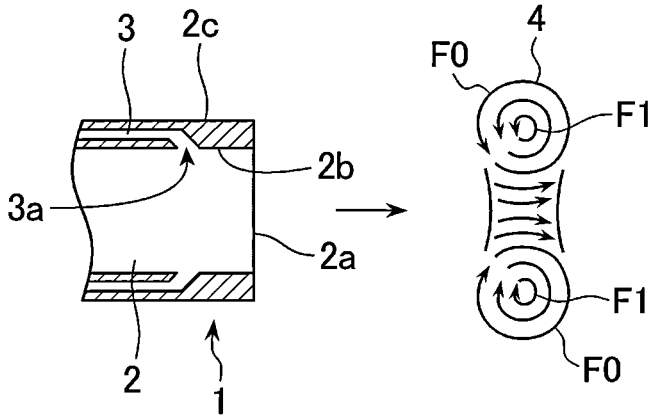
【Fig.4C】
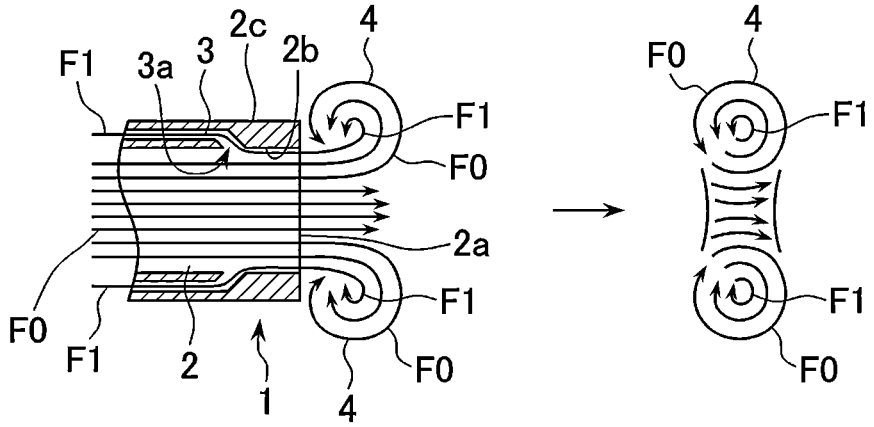

【Fig.5】
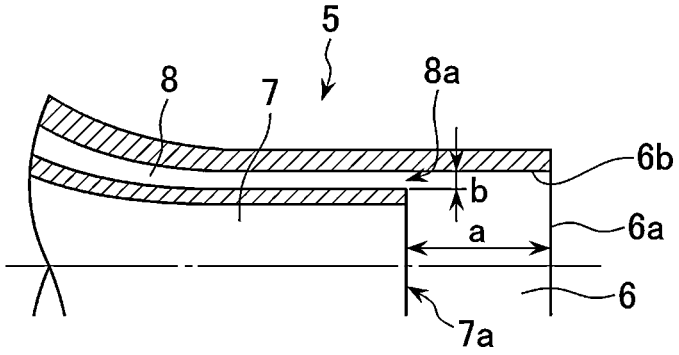
【Fig.6】
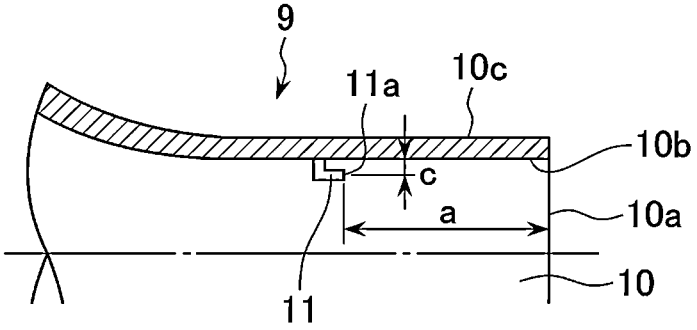

【Fig.7A】
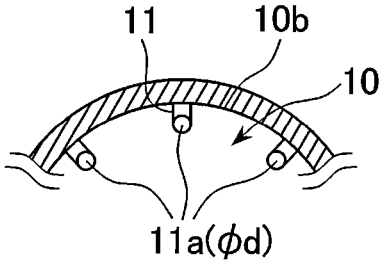
【Fig.7B】
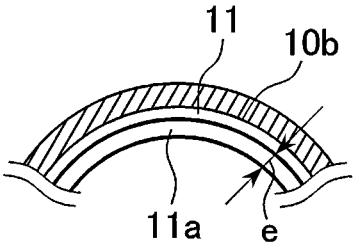

【Fig.8】
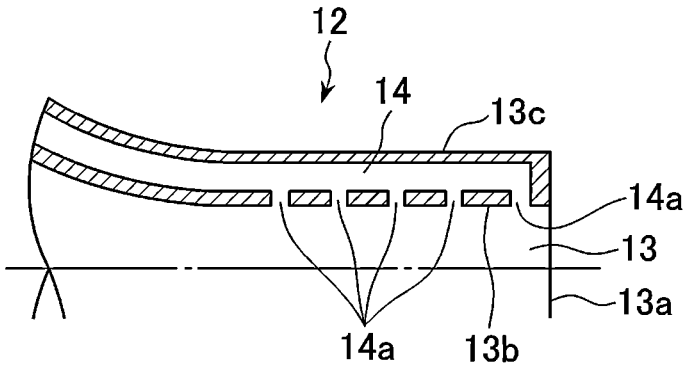
【Fig.9】
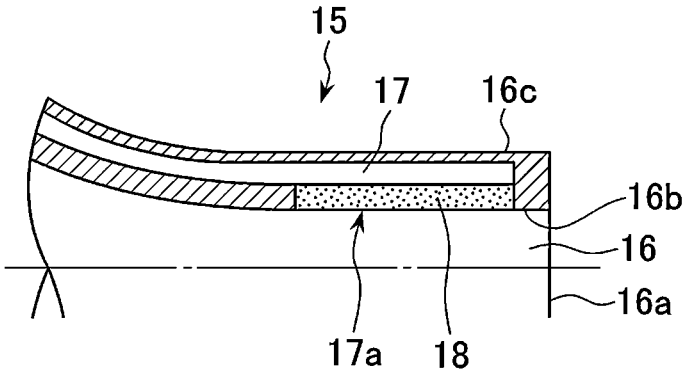
【Fig.10】
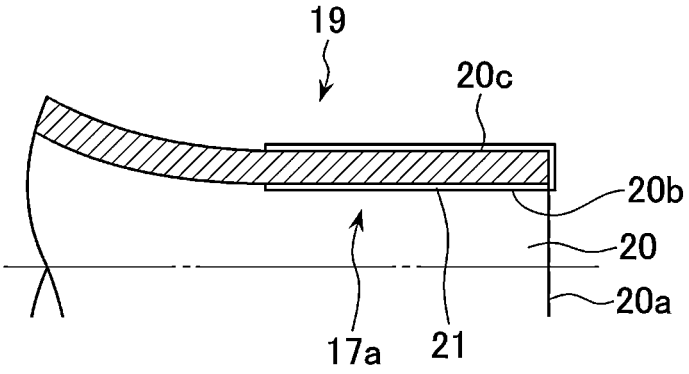

【Fig.11A】
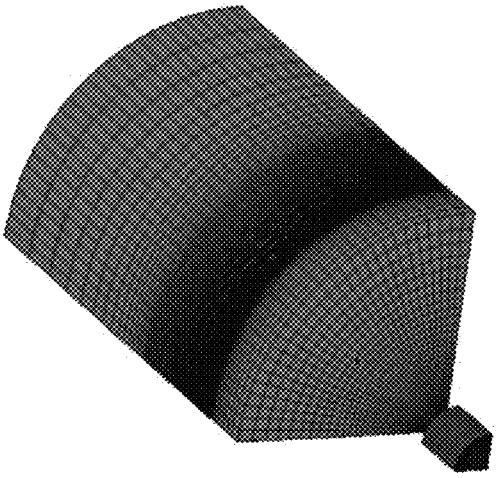
The axis-symmetry model
【Fig.11B】
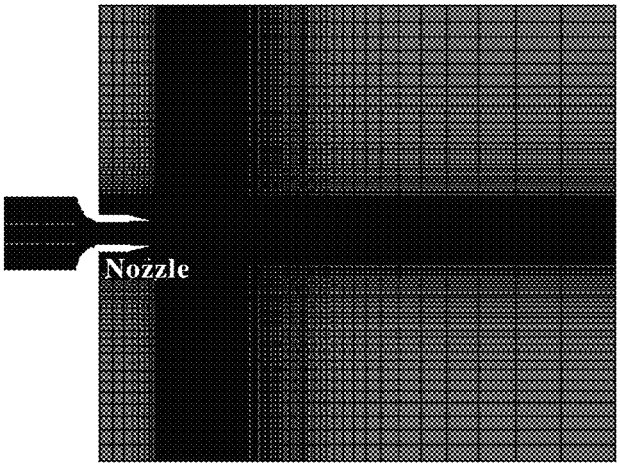
The full model
【Fig.11C】
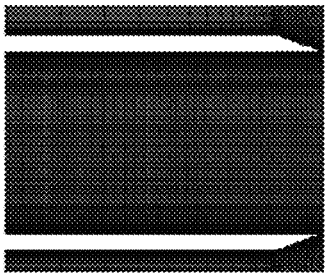

【Fig.12】
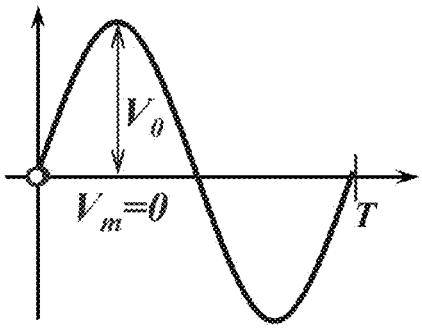
【Fig.13A】
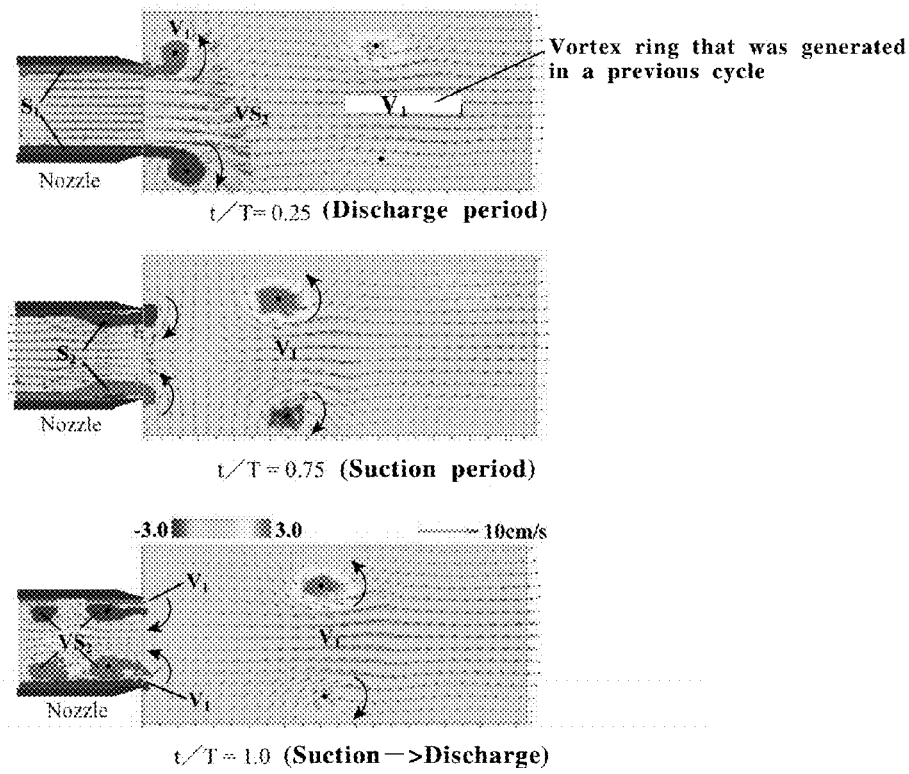

【Fig.13B】
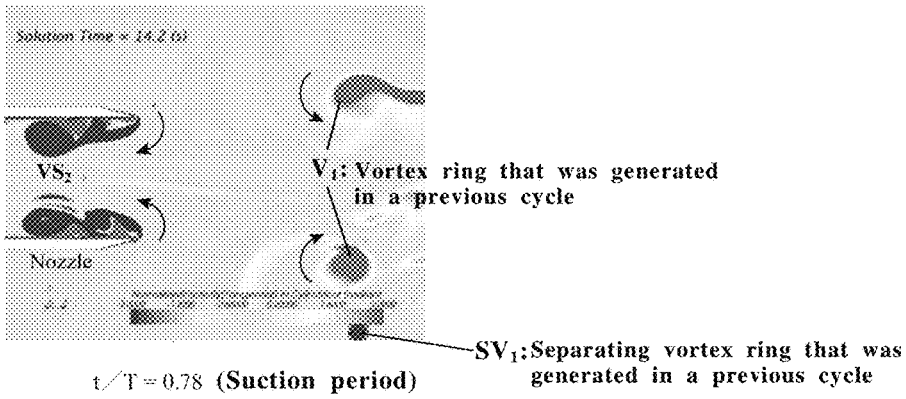
t/T = 0.78 (Suction period)
【Fig.13C】
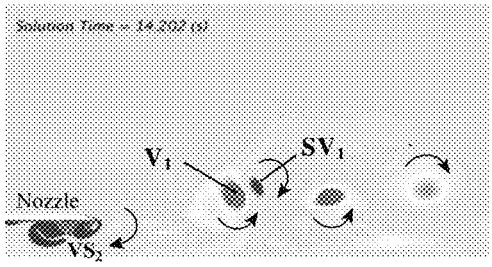
t/T = 0.78 (Suction period)

【Fig.14A】
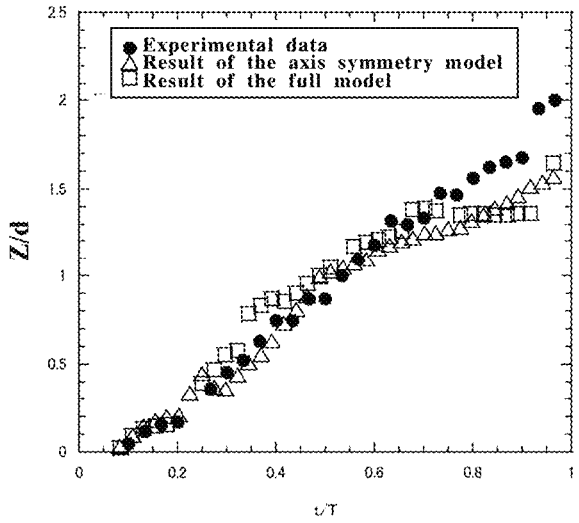
【Fig.14B】
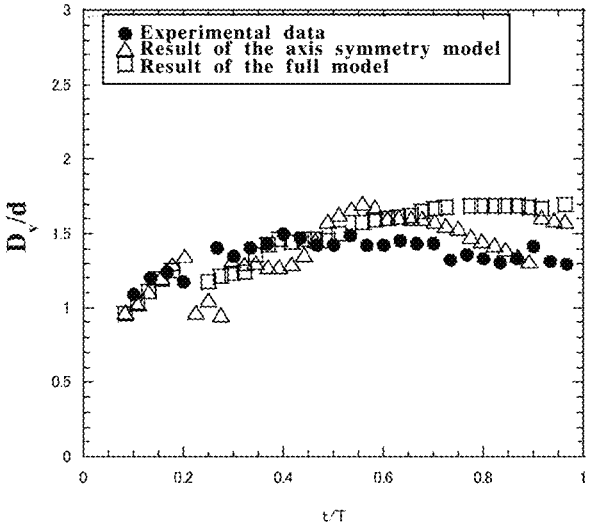

【Fig.15A】
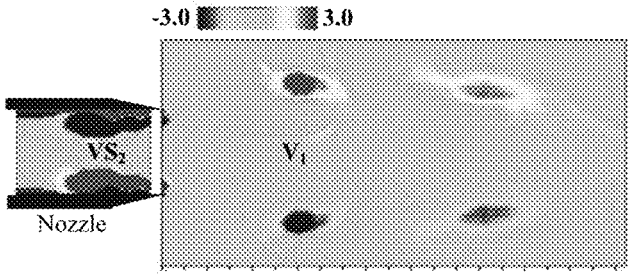
$V_0$ = 139.65 cm/s, T = 0.125 sec
t/T = 0.78 (Suction period)
【Fig.15B】
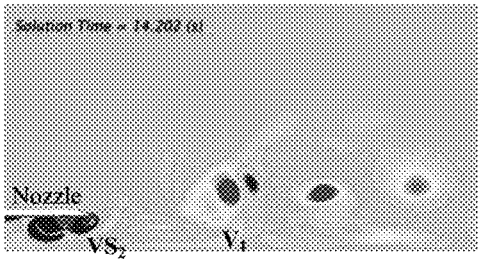
$V_0$ = 8.23 cm/s, T = 2.0 sec
t/T = 0.78 (Suction period)

【Fig.16】
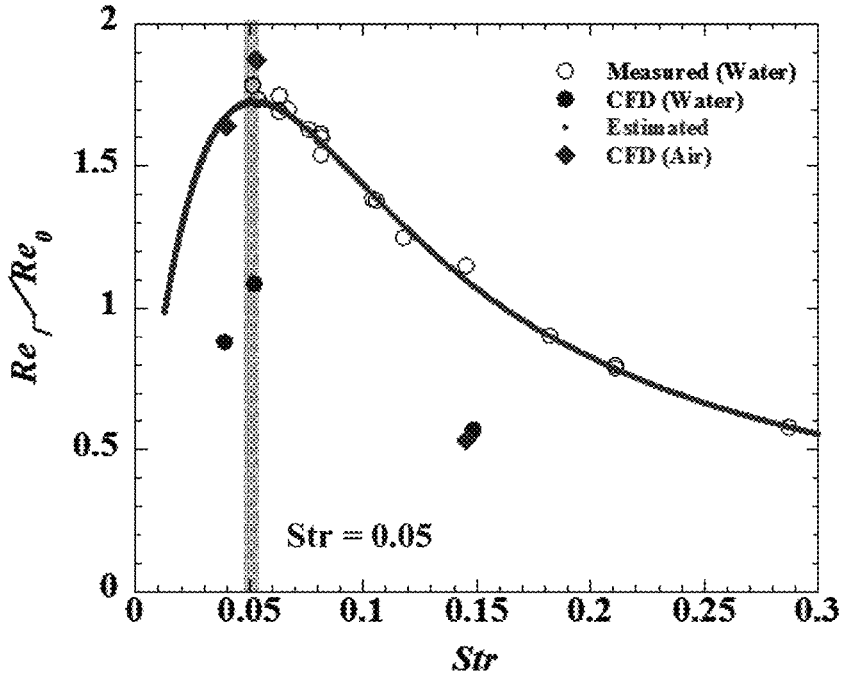
【Fig.17A】
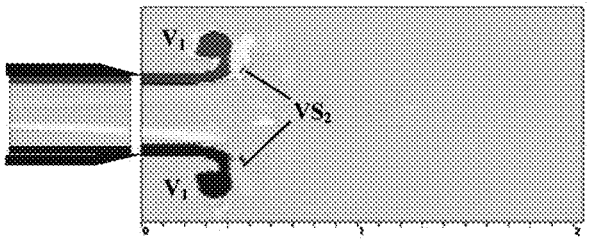
(a) t/T = 1.25 (Discharge period)
【Fig.17B】
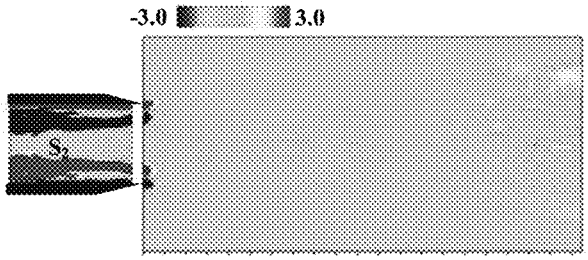
(b) t/T = 0.78 (Suction period)

【Fig.18A】
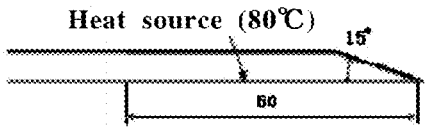
【Fig.18B】
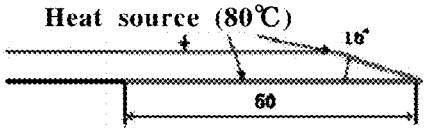
【Fig.18C】
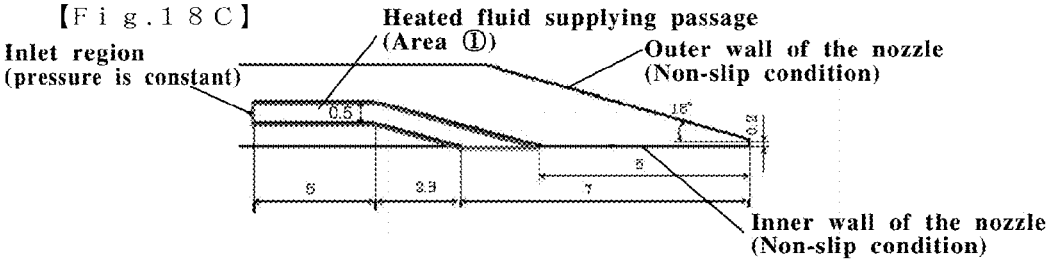

【Fig.19A】
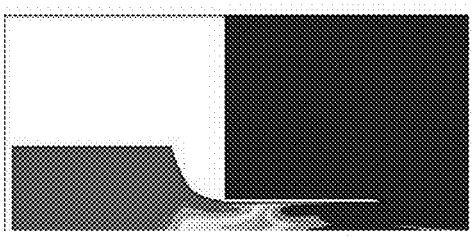
【Fig.19B】
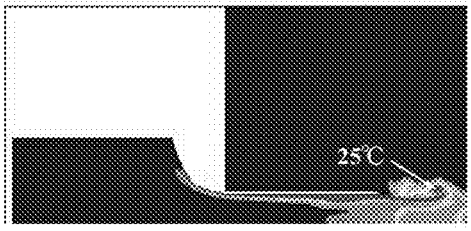
【Fig.19C】
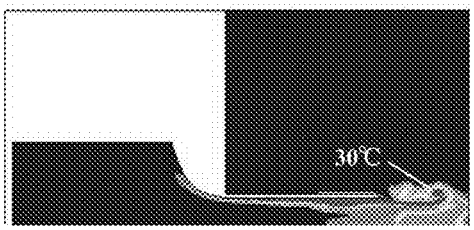
【Fig.19D】
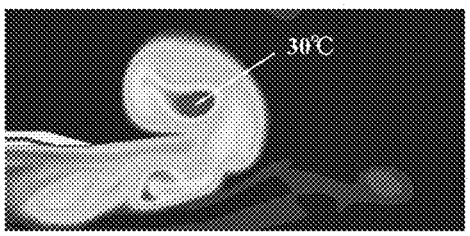

【Fig.19E】
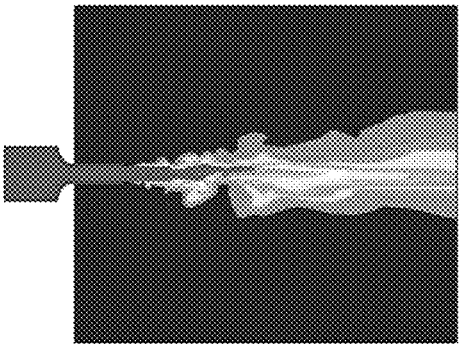
【Fig.20】
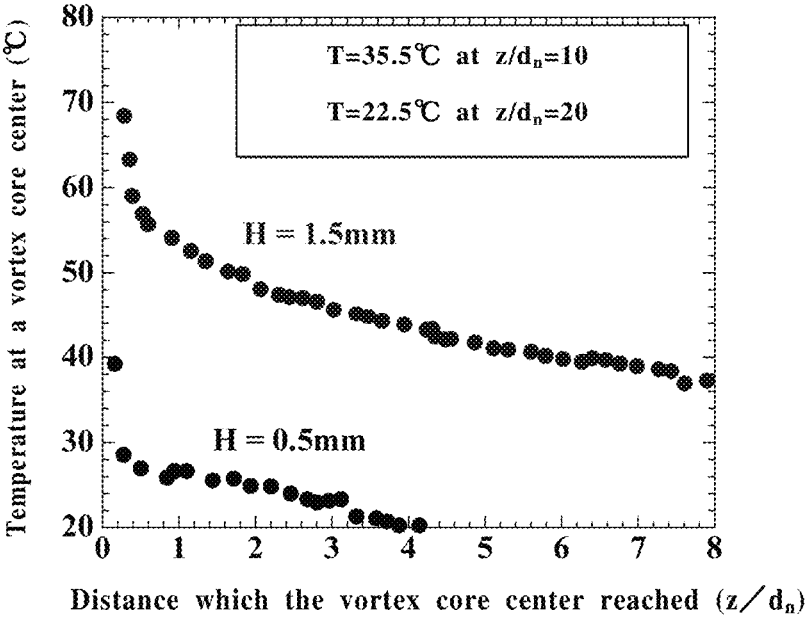

【Fig.21】
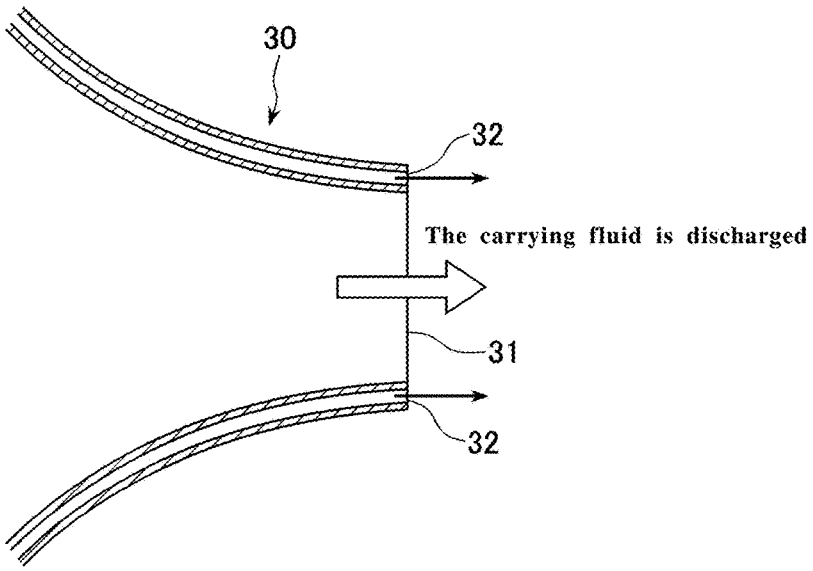
【Fig.22】
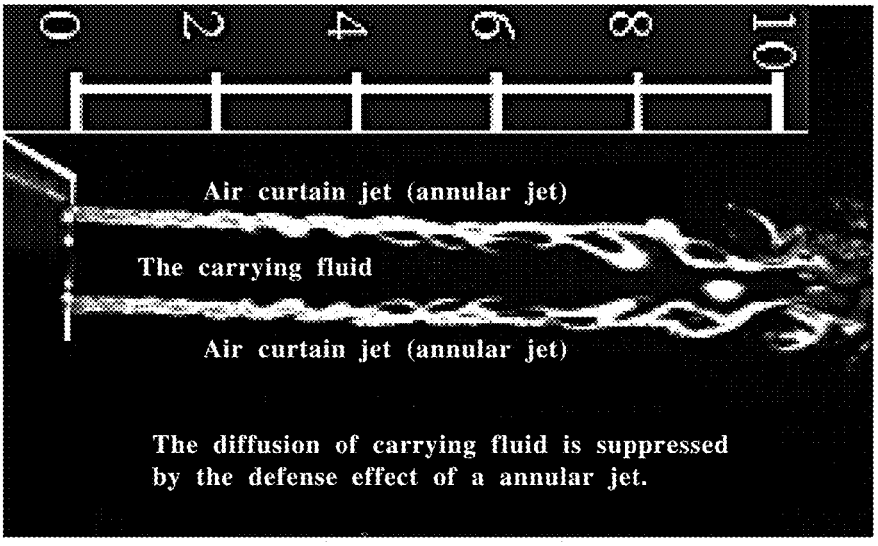

[Fig.23]
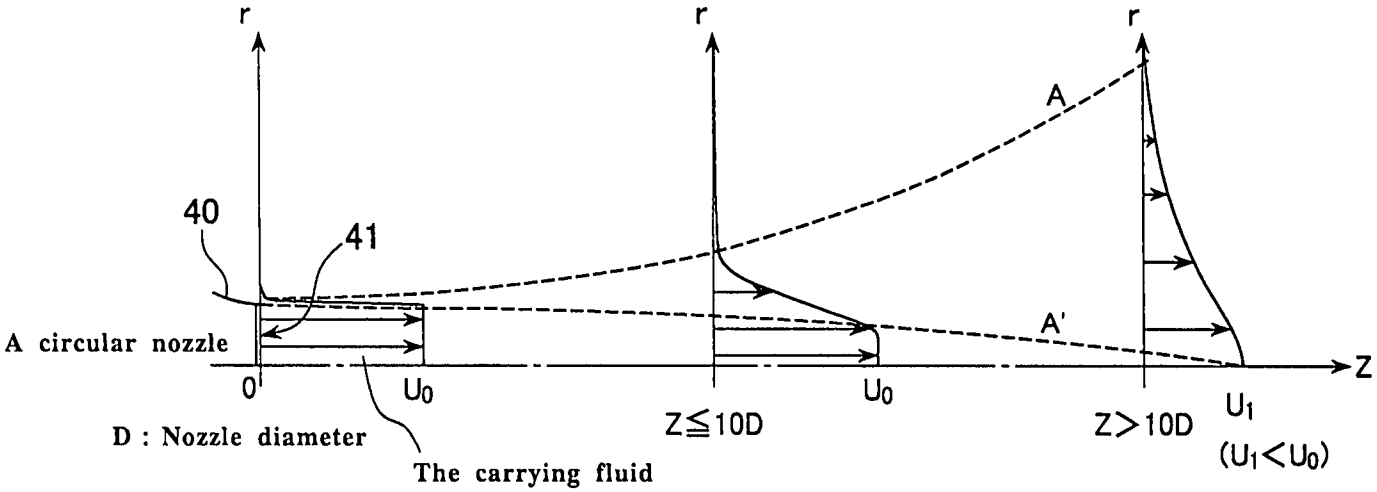

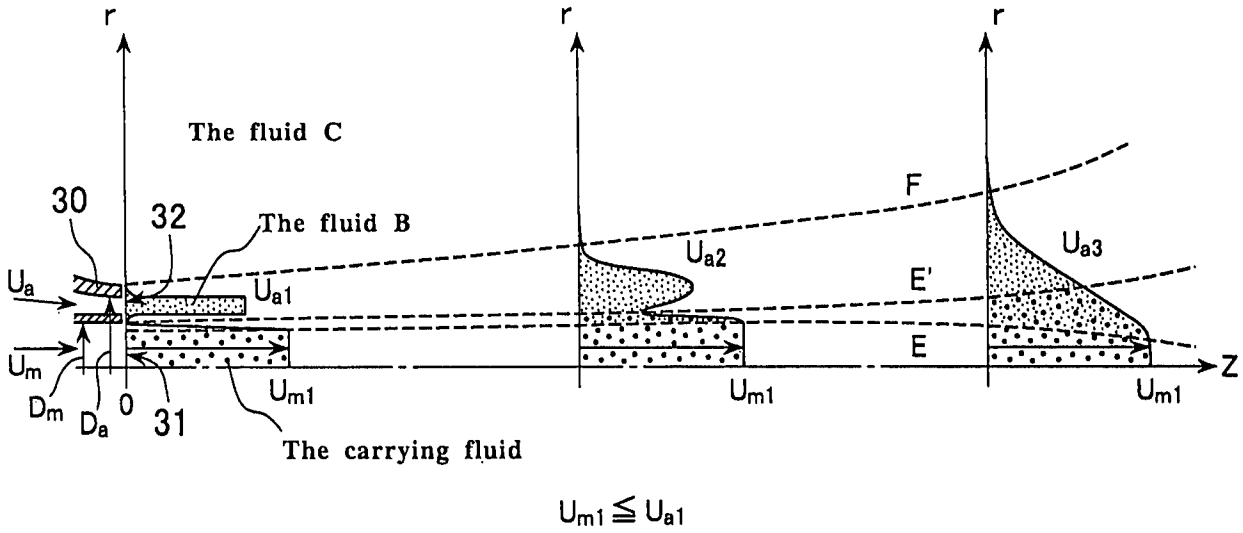
$D_m$ : The diameter of the nozzle by which a circular jet is discharged.
$D_a$ : The diameter of the nozzle by which a annular jet is discharged.
[Fig.24]

[Fig.25]
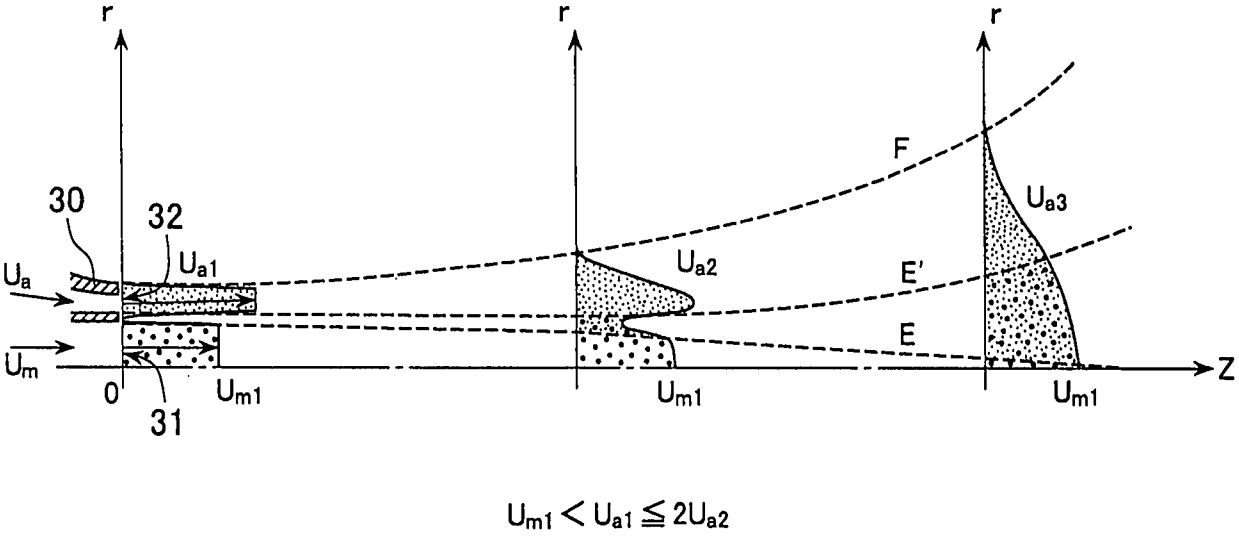

FLUID TRANSPORTATION DEVICE AND FLUID TRANSPORTATION METHOD

TECHNICAL FIELD

The present invention blows off fluid, such as gas and a fluid, to be conveyed from spurting parts into space, and it relates to a fluid transportation device and a fluid transportation method of conveying locally, suppressing diffusion to a target part away from spurting parts.

BACKGROUND OF THE INVENTION

By turning carrying gas to a target part from an air outlet, and blowing off into space, it is indicated by patent documents 1 as a gas transportation method which the carrying gas is made to reach to a target part.

The art indicated by patent documents 1 is art which makes annular the carrying gas which blew off from the air outlet.

And the shape of the section which intersects perpendicularly to the annular peripheral direction is circular.

The gas in which a section is circular and annular rotates centering on the center of a circular section, and a vortex ring is formed.

The vortex ring of the above-mentioned state moves towards a target place in space.

PRIOR ART DOCUMENT

Patent Documents

[Patent Documents 1]
JP, 7-332750, A

SUMMARY OF THE INVENTION

Problem(s) to be Solved by the Invention

In the above-mentioned conventional method, make the shape of a pulse carry out flow change of conveying gas itself, it is made to blow off from a blow-off mouth, and formation of a vortex ring and storing into the vortex ring of gas to be conveyed are performed simultaneously.

By this method, gas to be conveyed is not continuously stored in a vortex ring.

That is, it is difficult to carry out continuous and to convey, suppressing diffusion in the conventional method to the target spot which left carrying gas.

The present invention aims at the following thing.

The present invention provides the fluid conveying device which can convey fluid to be conveyed, and a fluid transportation method by blowing off fluid, such as gas and a fluid, to be conveyed from spurting parts into space, suppressing diffusion to the target part away from spurting parts.

Means for Solving the Problem

The fluid conveying device of the present invention has spurting parts which form a vortex ring by blowing off conveyance fluid from exhaust nozzle into space.

The device of the present invention has a fluid supply means which supplies fluid to be conveyed to the outside of conveyance fluid with the degree of low speed rather than the speed of the center of conveyance fluid to be conveyed.

The fluid transportation method of the present invention supplies fluid to be conveyed to the outside of conveyance fluid with the degree of low speed rather than the speed of the center of conveyance fluid while forming a vortex ring by blowing off conveyance fluid from an exhaust nozzle into space. * * *

According to these inventions, the fluid supplied to the outside of conveyance fluid with the degree of low speed rather than the speed of the center of conveyance fluid to be conveyed is directly stored into the vortex ring formed when wound by conveyance fluid by the exhaust nozzle, and is conveyed with a vortex ring.

As for a fluid supply means to be conveyed, it is desirable that it is a channel which carries out discharge of the fluid to be conveyed over the wall surface of spurting parts.

Since a vortex ring is formed when having been wound by conveyance fluid by the exhaust nozzle focusing on the fluid breathed out over the wall surface of spurting parts to be conveyed, fluid to be conveyed is stored in the central part of a vortex ring.

When conveying the heated fluid or the cooled fluid to a target part, the fluid supply means to be conveyed can generate fluid to be conveyed by the source of heating or the source of cooling provided in the wall surface of spurting parts.

Therefore, by heating or cooling by the source of heating or the source of cooling in which the conveyance fluid which forms a vortex ring was provided by the wall surface of spurting parts, it can involve in focusing on the portion by which this conveyance fluid was heated or cooled, and can form a vortex ring.

The fluid conveying machine of another example of the present invention has the 1st exhaust nozzle that spouts fluid to be conveyed on the conditions used as a laminar flow jet stream, and the 2nd exhaust nozzle.

The 2nd exhaust nozzle is annularly formed by ½ or less width of the diameter of the inscribed circle of the 1st exhaust nozzle so that the peripheral part of the 1st exhaust nozzle may be surrounded, and it spouts the 2nd fluid as an annular jet stream.

The fluid transportation method of another example of the present invention spouts fluid to be conveyed on the conditions used as a laminar-flow jet stream from the 1st exhaust nozzle.

And the 2nd exhaust nozzle is annularly formed by ½ or less width of the diameter of the inscribed circle of the 1st exhaust nozzle so that the peripheral part of the 1st exhaust nozzle may be surrounded.

The 2nd exhaust nozzle spouts the 2nd fluid as an annular jet stream.

According to these inventions, the annular jet stream which blows off from the 2nd exhaust nozzle plays a role of an air curtain, and suppresses diffusion of the fluid (henceforth a "main jet stream") which blows off on the conditions which serve as a laminar flow jet stream from the 1st exhaust nozzle to be conveyed.

Therefore, it becomes possible to convey locally, maintaining fluid to be conveyed in an annular jet stream.

Here, speed (what did division of the volume flow of the fluid spouted from the 1st exhaust nozzle to be conveyed with the cross-sectional area of the 1st exhaust nozzle) of the fluid (the main jet stream) spouted from the 1st exhaust nozzle to be conveyed is set to Um.

When speed (what did division of the volume flow of the 2nd fluid spouted from the 2nd exhaust nozzle with the cross-sectional area of the 2nd exhaust nozzle) of the 2nd fluid (annular jet stream) spouted from the 2nd exhaust nozzle is set to Ua, it is desirable that it is 0.25<=Ua/Um<=2.

More preferably it is Ua/Um<=1.

The optimal velocity ratio changes with the speed of the main jet stream, and at the jet speed of practical use within the limits, in order to prevent diffusion completely to the distance of 10D to be conveyed to diameter D of the 1st exhaust nozzle, it is set to 0.25<=Ua/Um<=2.

It is the optimal velocity ratio for conveying locally, while Ua/Um=0.75 has maintained fluid to be conveyed in the annular jet stream to target distance.

When set to Ua/Um>=1, the function as an air curtain of an annular jet stream falls gradually, and it stops almost functioning in Ua/Um>2.

In the condition of Ua/Um<0.25, although diffusion is controlled, it cannot prevents diffusion completely to the distance of 10D.

Effect of the Invention

According to the fluid conveying device and fluid transportation method of the present invention, by blowing off conveyance fluid from an exhaust nozzle into space, a vortex ring is formed and fluid to be conveyed is supplied to the outside of conveyance fluid with the degree of low speed rather than the speed of the center of conveyance fluid.

The fluid supplied to the outside of conveyance fluid with the degree of low speed rather than the speed of the center of conveyance fluid to be conveyed is directly stored into the vortex ring formed when wound by conveyance fluid by the exhaust nozzle.

It becomes possible to convey locally, suppressing diffusion to the target part which is distant from an exhaust nozzle with a vortex ring in fluid to be conveyed.

In the another fluid conveying device and fluid transportation method of the present invention, the conditions used as a laminar flow jet stream spout fluid to be conveyed from the 1st exhaust nozzle.

From the 2nd exhaust nozzle annularly formed by ½ or less width of the diameter of the inscribed circle of the 1st exhaust nozzle so that the peripheral part of the 1st exhaust nozzle might be surrounded, the 2nd fluid is spouted as an annular jet stream.

It becomes possible to convey locally, an annular jet stream's achieving the function as an air curtain, suppressing diffusion of fluid to be conveyed, and maintaining fluid to be conveyed in an annular jet stream.

BRIEF DESCRIPTION OF THE DRAWINGS

Drawing 1 is an expanded sectional view near the exhaust nozzle of the nozzle which constitutes the fluid conveying device in a 1st embodiment of the present invention.

Drawing 2 is a B-B' sectional view of the nozzle of Drawing 1.

Drawing 3A is the A section enlarged drawing showing the modification of the tip part of the nozzle of Drawing 1.

Drawing 3B is the A section enlarged drawing showing the modification of the tip part of the nozzle of Drawing 1.

Drawing 4A is an explanatory view showing the situation of fluid conveyance by the fluid conveying device of Drawing 1.

Drawing 4B is an explanatory view showing the situation of fluid conveyance by the fluid conveying device of Drawing 1.

Drawing 4C is an explanatory view showing the situation of fluid conveyance by the fluid conveying device of Drawing 1.

Drawing 5 is an expanded sectional view near the exhaust nozzle of the nozzle which constitutes the fluid conveying device in a 2nd embodiment of the present invention.

Drawing 6 is an expanded sectional view near the exhaust nozzle of the nozzle which constitutes the fluid conveying device in a 3rd embodiment of the present invention.

Drawing 7A is a longitudinal section showing the example of the nozzle which supplies the fluid of Drawing 6 to be conveyed.

Drawing 7B is a longitudinal section showing the example of the nozzle which supplies the fluid of Drawing 6 to be conveyed.

Drawing 8 is an expanded sectional view near the exhaust nozzle of the nozzle which constitutes the fluid conveying device in a 4th embodiment of the present invention.

Drawing 9 is an expanded sectional view near the exhaust nozzle of the nozzle which constitutes the fluid conveying device in a 5th embodiment of the present invention.

Drawing 10 is an expanded sectional view near the exhaust nozzle of the nozzle which constitutes the fluid conveying device in a 6th embodiment of the present invention.

Drawing 11A is an outline view of the calculation lattice model for the numeric simulation in the example of the present invention.

Drawing 11B is an outline view of the calculation lattice model for the numeric simulation in the example of the present invention.

Drawing 11C is an outline view of the calculation lattice model for the numeric simulation in the example of the present invention.

Drawing 12 is a wave form chart of flow change of the jet stream used as an example of the present invention.

Drawing 13A is a figure showing the formation process of the underwater vortex ring (water vortex ring) which used non-dimension whirlpool degree distribution.

Drawing 13B is a figure showing the formation process of the underwater vortex ring (water vortex ring) which used non-dimension whirlpool degree distribution.

Drawing 13C is a figure showing the formation process of the underwater vortex ring (water vortex ring) which used non-dimension whirlpool degree distribution.

Drawing 14A is a figure showing phase change of a vortex ring attainment position.

Drawing 14B is a figure showing phase change of a vortex ring diameter.

Drawing 15A is a figure showing the formation process of the vortex ring (air vortex ring) in the air which used non-dimension whirlpool degree distribution.

Drawing 15B is a figure showing the formation process of the underwater vortex ring (water vortex ring) which used non-dimension whirlpool degree distribution.

Drawing 16 is a figure showing the relation between non-dimension circulation of a vortex ring, and Strouhal number Str of a pulsating jet stream.

Drawing 17A is a figure in which circulation of a vortex ring shows the formation process of the air vortex ring on the pulsating conditions used as the maximum.

Drawing 17B is a figure in which circulation of a vortex ring shows the formation process of the air vortex ring on the pulsating conditions used as the maximum.

Drawing 18A is a schematic diagram showing the method for storing heat fluid into a vortex ring.

Drawing 18B is a schematic diagram showing the method for storing heat fluid into a vortex ring.

Drawing 18C is a schematic diagram showing the method for storing heat fluid into a vortex ring.

Drawing 19A is a figure showing the storing result into the vortex ring of heat fluid.

Drawing 19B is a figure showing the storing result into the vortex ring of heat fluid.

Drawing 19C is a figure showing the storing result into the vortex ring of heat fluid.

Drawing 19D is a figure showing the storing result into the vortex ring of heat fluid.

Drawing 19E is a figure showing the storing result into the vortex ring of heat fluid.

Drawing 20 is a figure showing the relation between the vortex ring central point temperature in the case of method 4, and the range of a vortex ring.

Drawing 21 is an expanded sectional view near the exhaust nozzle of the double nozzle which constitutes the fluid conveying device in a 7th embodiment of the present invention.

Drawing 22 is a figure showing the visualization photograph of the fluid which blows off from the tip part of the double nozzle of Drawing 21.

Drawing 23 is an explanatory view showing change of the speed distribution to distance Z from the exhaust nozzle of a single nozzle.

Drawing 24 is an explanatory view showing change of the speed distribution to distance Z from the 1st and 2nd exhaust nozzle of a double nozzle.

Drawing 25 is an explanatory view showing change of the speed distribution to distance Z from the 1st and 2nd exhaust nozzle of a double nozzle.

DESCRIPTION OF NOTATIONS

F0: Conveyance fluid
F1: Fluid to be conveyed
1, 5, 9, 12, 15, 19: Fluid conveying device
2, 6, 7, 10, 11, 13, 16, 20: Nozzle
2*a*, 6*a*, 7*a*, 10*a*, 11*a*, 13*a*, 16*a*, 20*a*: Exhaust nozzle
2*b*, 6*b*, 10*b*, 13*b*, 16*b*, 20*b*: Inside wall surface
2*c*, 10*c*, 13*c*, 16*c*, 20*b*: Outer wall surface
3, 8: Channel
3*a*, 8*a*: Exhaust nozzle
4: Vortex Ring
14, 17: Smallness space
14*a*, 17*a*: Opening
18: Filter Material
21: Source of Heating
30: Double Nozzle
31: 1st Exhaust Nozzle
32: 2nd Exhaust Nozzle
40: Single Nozzle
41: Exhaust Nozzle

[The Form for Invention]

(Embodiment 1)

Drawing 1 is an expanded sectional view near the exhaust nozzle of the nozzle which constitutes the fluid conveying device in a 1st embodiment of the present invention.

Drawing 2 is a B-B' sectional view of the nozzle of Drawing 1.

As shown in Drawing 1 and Drawing 2, fluid conveying device 1 in a 1st embodiment of the present invention is provided with nozzle 2 cylindrical as spurting parts which form a vortex ring by blowing off conveyance fluid F0 from exhaust nozzle 2*a* into space.

Fluid conveying device 1 has channel 3 which carries out exhalation of the fluid F1 to be conveyed over inner wall surface 2*b* of nozzle 2 as a fluid supply means which supplies fluid F1 to be conveyed to the outside of conveyance fluid F0 near the exhaust nozzle 2*a* to be conveyed.

Channel 3 is an annular small channel formed inside the wall of cylindrical nozzle 2 as shown in Drawing 2.

Fluid F1 to be conveyed is sent out from exhaust nozzle 3*a* of channel 3 toward the flow place of conveyance fluid F0 inside nozzle 2.

Although distance a from exhaust nozzle 2*a* of nozzle 2 of exhaust nozzle 3*a* of channel 3, unification angle theta to nozzle 2 of channel 3, and width b of channel 3 can be set up arbitrarily, it is desirable to set up so that fluid F1 to be conveyed may be carried to exhaust nozzle 2*a* over inner wall surface 2*b* of nozzle 2.

Channel 3 may provide and form partial or a prescribed interval, without forming annularly over all the circumferences.

Continuation formation of the vortex ring by conveyance fluid F0 is performed by fluctuating the discharge flow volume of conveyance fluid F0 made to blow off from exhaust nozzle 2*a*.

For example, the waveform of flow change can use the following periodic waveforms changed intermittently or arbitrarily.

(1) Sinusoidal-wave form
(2) The waveform to which the standup of a sine wave form or the acceleration of falling was changed
(3) A rectangular waveform
(4) Triangular wave form
(5) A trapezoid waveform
(6) The waveform of the shape of intermittence in which the flow included the stop section of zero between each cycle in the waveform of the above (1), (2), (3), and (5)
(7) The waveform which combined the waveform of the above (1), (2), (3), (4), and (6)

The size, the volume, the speed of advance, the strength (the difficulty of decreasing), and the distance that can be reached of the vortex ring formed can be adjusted.

The above-mentioned adjustment is performed by changing the turn of wave-like amplitude, a cycle, the length of an intermittent period, and a wave-like combination.

Fluid F1 to be conveyed is sent out from exhaust nozzle 3*a*, and the speed is lower than the speed of the center of conveyance fluid F0.

For example, fluid F1 to be conveyed is putting pressure on the upper stream side of channel 3, or pressurizing, fluctuating the pressure by the side of the upper stream of channel 3 according to the flow change, and is sent out from exhaust nozzle 3*a*.

Or it is also possible to send out without pressurizing using the pressure difference which arises by change of the flow in nozzle 2.

Continuous formation of vortex ring, in the jet flow rate of the ejection port 2*a* transport fluid F0 to be ejected from a constant, the jet flow rate of the transported fluid F1 to be sent out from the flow path 3, the center of the transport fluid F0 on the outside of the carrier fluid F0 it is also possible by varying the condition for a low speed than the speed.

As the fluctuation waveform of the ejection flow rate of the carrier fluid F1, it is possible to use a waveform shown in the above (1) to (7).

The tip part of nozzle 2 presupposes that it is perpendicular to the central axis of nozzle 2, as shown in the A section of Drawing 1, and also as shown in Drawing 3A, it may make tapered shape the outer wall surface 2*c* side, or as shown in Drawing 3B, it may make tapered shape the inner wall surface 2*b* side.

To form an accurate circular vortex ring are most desirable nozzle shown in FIG. 3A, then preferably the nozzle is a nozzle shown in FIG. 1A section:

It is possible to replace with nozzle 2 to also make exhaust nozzles, such as an orifice.

FIGS. 4A-4C are explanatory views showing states of fluid delivery by the fluid transport device 1 of FIG. 1.

From the channel 3 the transported fluid F1, it is supplied even at low speed than the speed of the center of the conveying fluid F0 on the outside of the carrier fluid F0.

Simultaneously, conveyance fluid F0 is intermittently blown off from exhaust nozzle 3*a* into space, for example.

Then, as shown in Drawing 4A, fluid F1 to be conveyed is directly stored into vortex ring 4 formed when wound by conveyance fluid F0 by exhaust nozzle 3*a*, and as shown in Drawing 4B, it is conveyed with vortex ring 4.

By performing the above operation intermittently, as shown in FIG. 4C, while suppressing the diffusion of the carrier fluid F1 to the target location remote from continuously spout 3*a* at predetermined time intervals, it is transported locally it is made possible.

In this embodiment, exhaust nozzle 3*a* of channel 3 which carries out exhalation of the fluid F1 to be conveyed is considered as the composition provided in inner wall surface 2*b* of nozzle 2.

It provides in the outer wall surface 2*c* side of nozzle 2, or exhaust nozzle 3*a* can also be provided in both inner wall surface 2*b* and outer wall surface 2*c*.

Fluid F1 to be conveyed is supplied to the outside of conveyance fluid F0 with the low speed rather than the speed of the center of conveyance fluid F0.

It may constitute so that fluid F1 to be conveyed may be stored into vortex ring 4 formed of this when wound by conveyance fluid F0 by exhaust nozzle 3*a*.

(Embodiment 2)

Drawing 5 is an expanded sectional view near the exhaust nozzle of the nozzle which constitutes the fluid conveying device in a 2nd embodiment of the present invention.

As shown in Drawing 5, fluid conveying device 5 in a 2nd embodiment of the present invention has still more cylindrical nozzle 7 inside cylindrical nozzle 6.

Conveyance fluid F0 is supplied by inside nozzle 7, and blows off from exhaust nozzle 6*a* of nozzle 6 into space intermittently.

Fluid F1 to be conveyed is supplied to the outside of conveyance fluid F0 with the degree of low speed rather than the speed of the center of conveyance fluid F0 from annular channel 8 formed between nozzle 6 and nozzle 7.

Or conveyance fluid F0 is supplied by a fixed discharge flow volume from nozzle 7, and blows off from exhaust nozzle 6*a* of nozzle 6 by a fixed flow all over space.

Fluid F1 to be conveyed is intermittently supplied to the outside of conveyance fluid F0 from annular channel 8 on the conditions which serve as the degree of low speed rather than the speed of the center of conveyance fluid F0.

Distance a from exhaust nozzle 8*a* of channel 8 to exhaust nozzle 6*a* of nozzle 6 (distance from exhaust nozzle 7*a* of nozzle 7 to exhaust nozzle 6*a*) and width b of channel 8 can be set up arbitrarily.

However, it is desirable to set up so that fluid F1 to be conveyed may be carried to exhaust nozzle 6*a* over inner wall surface 6*b* of nozzle 6.

About the method of sending out from channel 8 of fluid F1 to be conveyed, it is the same as that of a 1st embodiment.

It is the same as that of a 1st embodiment also about the shape of the tip part of nozzles 6 and 7.

In such a configuration, conveying the fluid F1 to be conveyed, while supplying at lower speed than the center velocity of the conveyance fluid F0 to the outside of the conveyance fluid F0 from the flow path 8, the intermittent ejection opening 6*a* into the space When conveyance fluid F0, the fluid F1 to be conveyed is stored directly into the vortex ring in which is formed by winding up the conveyance fluid F0 in spout 6*a*, and is conveyed along with the vortex ring.

It becomes possible to convey locally, suppressing diffusion of fluid F1 to be conveyed to the target part which is continuously distant from exhaust nozzle 6*a* at an interval for a predetermined period by performing this intermittently.

Or the discharge flow volume of conveyance fluid F0 supplied from nozzle 7 is fixed, while making it blow off from exhaust nozzle 6*a* of nozzle 6 by a fixed flow into space, and the discharge flow volume of fluid F1 supplied from channel 8 to be conveyed is intermittently supplied to the outside of conveyance fluid F0 on the conditions which serve as the degree of low speed rather than the speed of the center of conveyance fluid F0.

Also by this, it has been wound by conveyance fluid F0, and formation of a vortex ring is performed and direct storing into the vortex ring of fluid F1 to be conveyed is attained.

Or the discharge flow volume of conveyance fluid F0 supplied from nozzle 7 is fixed, making it blow off from exhaust nozzle 6*a* of nozzle 6 by a fixed flow into space, and the discharge flow volume of fluid F1 supplied from channel 8 to be conveyed is intermittently supplied to the outside of conveyance fluid F0 on the conditions which serve as the degree of low speed rather than the speed of the center of conveyance fluid F0.

Also by this, it has been wound by conveyance fluid F0, and formation of a vortex ring is performed and direct storing into the vortex ring of fluid F1 to be conveyed is attained.

In this embodiment, it is the structure where exhaust nozzle 7*a* of nozzle 7 which supplies conveyance fluid F0 has been arranged inside exhaust nozzle 6*a* of nozzle 6.

The structure where exhaust nozzle 7*a* of nozzle 7 has been arranged outside exhaust nozzle 6*a* of nozzle 6 in addition to this structure may be sufficient.

Or exhaust nozzle 7*a* of nozzle 7 and exhaust nozzle 6*a* of nozzle 6 can also be considered as the structure arranged on the same side.

Also in this case, fluid F1 to be conveyed is similarly supplied to the outside of conveyance fluid F0 with the degree of low speed rather than the speed of the center of conveyance fluid F0 from annular channel 8 formed between nozzle 6 and nozzle 7.

It has been wound by this by conveyance fluid F0 which blows off from exhaust nozzle 7*a* of nozzle 7 into space, and into the vortex ring formed of this, fluid F1 to be conveyed is stored directly and conveyed with a vortex ring.

(Embodiment 3)

Drawing 6 is an expanded sectional view near the exhaust nozzle of the nozzle which constitutes the fluid conveying device in a 3rd embodiment of the present invention.

As shown in Drawing 6, fluid conveying device 9 in a 3rd embodiment of the present invention provides intermittently nozzle 11 which constitutes the channel which supplies fluid F1 to be conveyed on inner wall surface 10*b* of cylindrical nozzle 10 which blows off conveyance fluid F0 into space.

Discharge jet 11 can have composition which has arranged exhaust nozzle 11*a* of two or more circle pipe shape with one piece or a prescribed interval on inner wall surface 10*b*, and composition which has arranged ring-shaped exhaust nozzle 11*a* which meets inner wall surface 10*a* as shown in Drawing 7B, as shown in Drawing 7A.

Or conveyance fluid F0 blows off from discharge jet 10 with constant flow into space.

Fluid F1 to be conveyed is intermittently supplied on the conditions which become the outside of conveyance fluid F0 from exhaust nozzle 11*a* of discharge jet 11 with the degree of low speed rather than the speed of the center of conveyance fluid F0.

Distance a from exhaust nozzle 11*a* of nozzle 11 to exhaust nozzle 10*a* of nozzle 10, height c from the inner wall surface 10*b* of the nozzle 10 to the center of the ejection port 11*a* of the nozzle 11, inner diameter ϕd of the exhaust nozzle 11*a* of the annular shape, and width e of ring-shaped exhaust nozzle 11 can be set up arbitrarily.

It is desirable to set up so that fluid F1 which blows off from exhaust nozzle 11*a* of nozzle 11 to be conveyed may be carried to exhaust nozzle 10*a* over inner wall surface 10*b* of nozzle 10.

About the method of sending out from nozzle 11 of fluid F1 to be conveyed, it is the same as that of a 1st embodiment.

It is the same as that of a 1st embodiment also about the shape of the tip part of nozzle 10.

Also in such composition, fluid F1 to be conveyed is supplied to the outside of conveyance fluid F0 with the degree of low speed rather than the speed of the center of conveyance fluid F0 from exhaust nozzle 11*a* of nozzle 11, it is directly stored into the vortex ring formed when fluid F1 to be conveyed winds by blowing off conveyance fluid F0 from exhaust nozzle 10*a* into space intermittently and it has been wound by conveyance fluid F0 by exhaust nozzle 10*a*, and is conveyed with a vortex ring.

It becomes possible to convey locally, suppressing diffusion of fluid F1 to be conveyed to the target part which is continuously distant from exhaust nozzle 10*a* at an interval for a predetermined period by performing this intermittently.

Or fluid F1 to be conveyed is supplied to the outside of conveyance fluid F0 from exhaust nozzle 11*a* of nozzle 11 more nearly intermittently on condition of the degree of low speed than the speed of the center of conveyance fluid F0, and by blowing off conveyance fluid 10 from exhaust nozzle 10*a* by a fixed flow into space, fluid 11 to be conveyed is directly stored into the vortex ring formed when wound by conveyance fluid F0 by exhaust nozzle 10*a*, and is conveyed with a vortex ring.

It becomes possible to convey locally, suppressing diffusion of fluid F1 to be conveyed to the target part which is continuously distant from exhaust nozzle 10*a* at an interval for a predetermined period by performing this intermittently.

In this embodiment, although nozzle 11 which carries out exhalation of the fluid F1 to be conveyed is considered as the composition provided in inner wall surface 10*b* of nozzle 10, it is also possible to provide nozzle 11 in the outer wall surface 10*c* side of nozzle 10, or to provide it in both inner wall surface 10*b* and outer wall surface 10*c*.

Fluid F1 to be conveyed may be supplied to the outside of conveyance fluid F0 with the degree of low speed rather than the speed of the center of conveyance fluid F0, and it may constitute so that it may be directly stored into the vortex ring formed when wound by conveyance fluid F0 by exhaust nozzle 10*a*.

(Embodiment 4)

Drawing 8 is an expanded sectional view near the exhaust nozzle of the nozzle which constitutes the fluid conveying device in a 4th embodiment of the present invention.

As shown in Drawing 8, fluid conveying device 12 in a 4th embodiment of the present invention has small space 14 used as the channel which supplies fluid F1 to be conveyed intermittently in the wall surface of cylindrical nozzle 13 which blows off conveyance fluid F0 into space.

Openings 14*a*, such as a hole for supplying fluid F1 to be conveyed to the outside of conveyance fluid F0 from small space 14 and a slit, are provided in inner wall surface 13*b* of nozzle 13.

Conveyance fluid F0 blows off from nozzle 13 by a fixed flow to space.

Fluid F1 to be conveyed is intermittently supplied to the outside of conveyance fluid F0 at a speed lower than the speed of the center of conveyance fluid F0 from opening 14*a* provided in small space 14.

The size of small space 14, volume and the size of opening 14*a*, an installed position, an installation interval, and the number can be set up arbitrarily, and it is desirable to set up so that fluid F1 which blows off from opening 14*a* to be conveyed may be carried to exhaust nozzle 13*a* over inner wall surface 13*b* of nozzle 13.

Regarding how to send out fluid F1 to be conveyed, it is the same as that of a 1st embodiment.

Also about the shape of the tip part of nozzle 13, it is the same as that of a 1st embodiment.

With such a structure, fluid F1 to be conveyed is supplied to the outside of conveyance fluid F0 with the degree of low speed rather than the speed of the center of conveyance fluid F0 from opening 14*a* of small space 14, if conveyance fluid F0 blows off from exhaust nozzle 13*a* into space intermittently, fluid F1 to be conveyed will be directly stored into the vortex ring formed when wound by conveyance fluid F0 by exhaust nozzle 13*a*, and will be conveyed with a vortex ring.

It becomes possible to convey locally, suppressing diffusion of fluid F1 to be conveyed to the target part which is continuously distant from exhaust nozzle 13*a* at the predetermined intervals by performing this intermittently.

Or fluid F1 to be conveyed is intermittently supplied to the outside of conveyance fluid F0 from opening 14*a* of small space 14 on the conditions which serve as the degree of low speed rather than the speed of the center of conveyance fluid F0, if conveyance fluid F0 is blown off from exhaust nozzle 13*a* by a fixed flow into space, fluid F1 to be conveyed will be directly stored into the vortex ring formed when wound by conveyance fluid F0 by exhaust nozzle 13*a*, and will be conveyed with a vortex ring.

It becomes possible to convey locally, suppressing diffusion of fluid F1 to be conveyed to the target part which is continuously distant from exhaust nozzle 13*a* at an interval for a predetermined period by performing this intermittently.

In this embodiment, opening 14*a* which spouts fluid F1 to be conveyed from small space 14 is provided in inner wall surface 13*b* of nozzle 13.

It is also possible to provide opening 14*a* in the outer wall surface 13*c* side of nozzle 13, or to provide it in both inner wall surface 13*b* and outer wall surface 13*c*.

Fluid F1 to be conveyed is supplied to the outside of conveyance fluid F0 with the degree of low speed rather than the speed of the center of conveyance fluid F0.

It is made to be directly stored into the vortex ring formed of this when wound by conveyance fluid F0 by exhaust nozzle 13*a*.

(Embodiment 5)

Drawing 9 is an expanded sectional view near the exhaust nozzle of the nozzle which constitutes the fluid conveying device in a 5th embodiment of the present invention.

As shown in Drawing 9, fluid conveying device 15 in a 5th embodiment of the present invention provided small space 17 which constitutes the channel which supplies fluid F1 to be conveyed in the wall surface of cylindrical nozzle 16 which blows off conveyance fluid F0 into space intermittently.

Opening 17*a* for supplying fluid F1 to be conveyed to the outside of conveyance fluid F0 from small space 17 is provided in inner wall surface 16*b* of nozzle 16.

Filter material 18 constituted with a porous material, a fiber material, an osmosis film, etc. is formed in this opening 17*a*.

The size of the size of small space 17, volume, opening 17*a*, and filter material 18, an installed position, an installation interval, and the number can be set up arbitrarily.

It is desirable to carry fluid F1 to be conveyed which blows off from opening 17*a* to exhaust nozzle 16*a* over inner wall surface 16*b* of nozzle 16.

Regarding how to send out fluid F1 to be conveyed, it is the same as that of a 1st embodiment.

It is the same as that of a 1st embodiment also about the shape of the tip part of nozzle 16.

Fluid F1 to be conveyed is supplied to the outside of conveyance fluid F0 with the degree of low speed rather than the speed of the center of conveyance fluid F0 via filter material 18 from opening 17*a* of small space 17.

Conveyance fluid F0 is intermittently blown off from exhaust nozzle 16*a* into space, Fluid F1 to be conveyed is directly stored into the vortex ring formed when wound by conveyance fluid F0 by exhaust nozzle 16*a*, and is conveyed with a vortex ring.

It becomes possible to convey locally, suppressing diffusion of fluid F1 to be conveyed to the target part which is continuously distant from exhaust nozzle 16*a* at an interval for a predetermined period by performing this intermittently.

In this embodiment, opening 17*a* and filter material 18 which spout fluid F1 to be conveyed were formed in inner wall surface 16*b* of nozzle 16.

It is also possible to provide opening 17*a* in the outer wall surface 16*c* side of nozzle 16, or to provide it in both inner wall surface 16*b* and outer wall surface 16*c*.

Fluid F1 to be conveyed is supplied with the degree of low speed rather than the speed of the center of conveyance fluid F0 on the outside of conveyance fluid F0.

It constitutes so that it may be directly stored into the vortex ring formed of this when wound by conveyance fluid F0 by exhaust nozzle 16*a*.

(Embodiment 6)

Drawing 10 is an expanded sectional view near the exhaust nozzle of the nozzle which constitutes the fluid conveying device in a 6th embodiment of the present invention.

Fluid conveying device 19 in a 6th embodiment of the present invention conveys the heated fluid to a target part.

As shown in Drawing 10, source 21 of heating is intermittently provided into space at inner wall surface 20*b* and outer wall surface 20*c* of cylindrical nozzle 20 which blow off conveyance fluid F0.

The size, installed position, and installation area of the field in which source 21 of heating is established can be set up arbitrarily.

About the shape of the tip part of nozzle 20, it is the same as that of a 1st embodiment.

In such composition, conveyance fluid F0 is intermittently blown off from exhaust nozzle 20*a* of nozzle 20 into space.

Thereby, fluid F1 heated by source 21 of heating to be conveyed is generated by inner surface 20*b* and peripheral face 20*c* of nozzle 20.

This generated fluid F1 to be conveyed is directly stored into the vortex ring formed (wound by conveyance fluid F0 by exhaust nozzle 20*a*), and is conveyed with a vortex ring.

It becomes possible to convey locally, suppressing diffusion of fluid F1 to be conveyed to the target part which is continuously distant from exhaust nozzle 20*a* at an interval for a predetermined period by performing this intermittently.

In this embodiment, although it has composition which established source 21 of heating in both inner surface 20*b* of nozzle 20, and peripheral face 20*c*, it is also possible to have composition provided only in either one of inner surface 20*b* or a peripheral face 20*c*.

Fluid F1 heated on the outside of conveyance fluid F0 to be conveyed is made to generate, and it supplies with the degree of low speed rather than the speed of the center of conveyance fluid F0.

It may constitute so that it may be directly stored into the vortex ring formed when having been wound by conveyance fluid F0 by exhaust nozzle 20*a* by this.

It becomes possible to convey the cooled fluid to a target part by having composition which replaced with source 21 of heating and provided the source of cooling.

(Embodiment 7)

Drawing 21 is an expanded sectional view near the exhaust nozzle of the double discharge jet which constitutes the fluid transportation device in a 7th embodiment of the present invention.

The fluid conveying machine in a 7th embodiment of the present invention is provided with double nozzle 30 which consists of the 1st exhaust nozzle 31 and the 2nd annular exhaust nozzle 32 formed so that the peripheral part of the 1st exhaust nozzle 31 might be surrounded as shown in Drawing 21.

In this embodiment, the 1st exhaust nozzle 31 is cylindrical.

The 2nd exhaust nozzle 32 is a coaxially with the 1st exhaust nozzle 31.

The 2nd exhaust nozzle 32 is cylindrical and has ½ or less width of the diameter of the 1st exhaust nozzle 31.

Fluid to be conveyed spouts from the 1st exhaust nozzle 31 on the conditions used as a laminar flow jet stream.

Specifically, the conditions of the fluid spouted from the 1st exhaust nozzle 31 to be conveyed are carried out as follows.

It is larger than zero and makes Reynolds number Re (=rhoU0 D/mu=U 0 D/nu, rho: density, the section average speed of a U0: jet stream, the diameter of D: exhaust nozzle 31, mu: viscosity coefficient, nu: dynamic viscosity) or less into 2000.

On the other hand, from the 2nd exhaust nozzle 32, the 2nd fluid other than the fluid spouted from the 1st exhaust nozzle 31 to be conveyed is spouted as an annular jet stream.

The 2nd fluid can also be considered as the same fluid as fluid to be conveyed.

When, the velocity of 1st fluid to be conveyed is Um, and the velocity of the 2nd fluid is Ua, the ratio Um and Ua (Ua/Um) is set up so that 0.25<=Ua/Um<=2.

Drawing 22 shows the visualization photograph of the fluid which blows off from the tip part of double nozzle 30 of Drawing 21.

As shown in Drawing 22, in the fluid conveying device in this embodiment, the annular jet stream which blows off from the 2nd exhaust nozzle 32 functions as an air curtain.

An air curtain suppresses diffusion of the fluid which blows off on the conditions which serve as a laminar flow jet stream from the 1st exhaust nozzle 31 to be conveyed.

Therefore, it can be conveyed locally, this device suppressing diffusion maintaining fluid to be conveyed in an annular jet stream.

The diffusion situation of fluid to be conveyed changes to the condition of Ua/Um.

It is the optimal velocity ratio for conveying locally, suppressing diffusion, while Ua/Um=0.75 has maintained fluid to be conveyed in the annular jet stream to target distance.

In the fluid conveying device in this embodiment, it is possible to convey the distant part of 50 cm or more as a target distance from the tip of double nozzle 30, maintaining fluid to be conveyed in an annular jet stream.

As for the position of the 1st exhaust nozzle 31, and the physical relationship of the 2nd exhaust nozzle 32, it is desirable to consider it as the same position mutually, as shown in Drawing 21.

If the physical relationship of both exhaust nozzles is within the limits of the diameter of exhaust nozzle 31, even if a difference will arise in the position of both exhaust nozzle, the annular jet stream which blows off from the 2nd exhaust nozzle 32 functions as an air curtain.

Therefore, fluid can blow off on the conditions which serve as a laminar-flow jet stream from the 1st exhaust nozzle 31, and can suppress diffusion of fluid to be conveyed.

The position of the 1st exhaust nozzle 31 and the tip part of the 2nd exhaust nozzle 32 make the outer wall surface of a discharge jet tapered shape, or are good also considering the inner wall surface of a discharge jet as tapered shape.

In order to suppress diffusion of fluid to be conveyed, what has it makes tapered shape the outer wall surface side of a discharge jet. [most desirable what is shown in Drawing 21 and desirable then]

It is possible to replace with a discharge jet to also make spurting parts, such as an orifice.

The fluid transportation device of this example can convey and warm clean warm air by non-contact to the clean skin side of the patient under operation.

It was conventionally difficult for the large area to maintain a scalded patient's body temperature, and the danger of decreased body temperature was high.

By using the fluid transportation device of this example, it may be able to contribute to safe patient care.

There are few physical covers as same usage, and it may be able to use for the easy new incubator of management.

The warm air which it was clean at the time of an endoscopic operation, and was dried from the circumference of the endoscope at it is conveyed, and the humidified warm air is conveyed from the outer layer.

By this, a patient can be warmed and the fall of the body temperature can be prevented.

It is also possible to prevent the dull deposits of an endoscope and to maintain the environment in the abdominal cavity at a good state.

When pouring a fluid to an endoscope, a patient's body temperature can be adjusted by passing 液対 which carried out temperature controlling to the circumference of the field of view of an endoscope.

Even if it bleeds during an operation, this blood is shed with a fluid and the field of view of an endoscope can be secured.

It is possible to supply pure air to those who have to work in the polluted air using the device of the present invention.

It is also possible to send temperature controlled carbon dioxide gas to a specific plant and to use for the temperature controlling and growth promotion of the plant in Green House.

In this example, the 1st exhaust nozzle 31 is perfect circle tubed.

The 2nd exhaust nozzle 32 is a coaxially with the 1st exhaust nozzle 31.

The shape of the 1st exhaust nozzle 31 and the 2nd exhaust nozzle 32 is not restricted to these.

for example, the cross section of the 1st exhaust nozzle 31 is made into elliptic form, and the 2nd exhaust nozzle 32 is corresponded to this—suppose that it is annular.

The thing which make polygonal shape the cross section of the 1st exhaust nozzle 31, and corresponds the 2nd exhaust nozzle 32 to this and it is supposed that it is annular is also possible.

The 2nd exhaust nozzle 32 is cylindrical and has ½ or less width of the diameter of the 1st exhaust nozzle 31.

Next, the diffusion situation of velocity-ratio Ua/Um of double discharge jet 30 and fluid to be conveyed in this example is explained in detail.

(1) Velocity distribution of a laminar-flow jet stream, and diffusion of fluid to be conveyed First, in order to compare, the case where it blows off from the tip of a single discharge jet (single discharge jet) considering fluid to be conveyed as a laminar-flow jet stream is explained.

Drawing 23 shows the case where it blows off from the tip of a single discharge jet considering fluid to be conveyed as a laminar-flow jet stream.

This figure is an explanatory view showing change of the velocity distribution over distance Z from a discharge-jet exhaust nozzle.

As shown in Drawing 23, the velocity distribution of the jet stream (fluid to be conveyed) in exhaust nozzle 41 of single discharge jet 40 turns into uniform distribution of speed U0 in the case of 0<=r<=D/2.

With the above-mentioned expression, :r is the distance from the main axis of single discharge jet 40, and D is a diameter of exhaust nozzle 41.

Within the outer radius r>D/2 in the width smaller than the inner wall of the single nozzle 40 indicates 0. The distribution rate is abruptly reduced (broken line A-A' between the figure), the shape is a rectangular shape in a shape close to a (cylindrical in three dimensions).

At this time, between the fluid from which speed is changing rapidly to be conveyed, and surrounding fluid (between broken-line A-A'), a big shear force works by the speed difference, and the mixed effect of fluid arises.

This mixed effect generates the operation to which fluid to be conveyed spreads in radial outside (r is a positive direction), i.e., diffusion of fluid to be conveyed.

And the mixed effect of fluid to be conveyed advances gradually as it progresses downstream.

Thereby, the speed of fluid to be conveyed falls gradually from the radius outside.

The speed of circumference fluid increases gradually on the contrary.

As this result, the width (width between broken-line A-A') of the area which mixture of fluid has produced spreads as it progresses downstream (that is, spread).

The width of the field where speed shows the uniform distribution of U0 on the contrary becomes small.

Progressing downstream, the field where speed shows the uniform distribution of U0 disappears in the position of Z=10D.

Maximum speed U1 of a jet stream becomes smaller than U0 rather than this in a downstream position.

And diffusion of fluid to be conveyed progresses rapidly and the width between broken-line A-A' increases rapidly.

Change of the velocity distribution mentioned above is seen when spray velocity U0 of fluid to be conveyed is set up on the conditions used as Reynolds-number Re(=U0D/nu)<=1500.

Here, D is a diameter of exhaust nozzle 41 of single discharge jet 40.

ν is a coefficient of kinematic viscosity of fluid to be conveyed.

When spray velocity U0 of fluid to be conveyed is set to Re>1500 and the speed difference between broken-line A-A' is enlarged, a very big shear force works between fluid to be conveyed and circumference fluid.

By line elasticity, the mixed effect of fluid becomes strong and it diffuses fluid to be conveyed rapidly as a result.

(2) Explain the velocity distribution of a jet stream and the diffusion of fluid to be conveyed which blew off from the double discharge jet, next explain double discharge jet 30 in this embodiment

[In the Case of Annular Jet Stream Speed Ua/Main-Jet Speed Um<=1]

Drawing 24 shows the state where blew off fluid A to be conveyed from the 1st exhaust nozzle 31 of double nozzle 30, and it blew off fluid B from the 2nd exhaust nozzle 32 as the 2nd fluid.

Fluid A to be conveyed blows off as a main jet stream (laminar flow jet stream) of section average speed Um.

Second fluid B blows off from the 2nd exhaust nozzle 32 as an annular jet stream of section average speed Ua.

Drawing 2 is an explanatory view showing change of the speed distribution to distance Z from the 1st and 2nd exhaust nozzle 31 and 32 at the time of making it blow off in fluid C on condition of velocity ratio Ua/Um<=1 of both jet streams.

As shown in Drawing 24, speed distribution of the main jet stream (fluid A to be conveyed) in the 1st exhaust nozzle 31 (Z=0) of double nozzle 30 turns into uniform distribution of speed Um1 in 0<=r<=Dm/2 (Dm: diameter of the 1st exhaust nozzle 31).

Speed distribution shows the state where speed becomes small rapidly in slight width (between dashed line E-E' in a figure), and is set to 0 on condition of r>Dm/2, and, as for the shape, the shape near rectangular form (cylindrical in three dimensions) is shown.

Similarly, speed distribution of the annular jet stream (fluid B) in the 2nd exhaust nozzle (Z=0) of double nozzle 30 also turns into uniform distribution of speed Ua1 in Dm/2<r<=Da/2.

Speed distribution shows the distribution which speed becomes small rapidly in width slight at r>Da/2, and is set to 0, and, as for the shape, the shape near rectangular form (it pierced through the range of r<Dm/2 in three dimensions—cylindrical) is shown.

At this time, it originates in the shearing force which arose by the velocity differential like the case of a laminar flow jet stream, and the mixed effect of fluid occurs, according to this effect, fluid B is diffused on the radius outside and fluid C is diffused in a radius inner side on the radius outside (boundary part of fluid B and fluid C) of an annular jet stream.

This mixed effect advances gradually as it progresses in the direction of the lower stream.

Thereby, the speed of fluid B falls gradually from the radius outside, and the speed of fluid C increases gradually on the contrary.

As this result, the width (width between dashed line E'-F) of the field which mixture of fluid has produced spreads.

The width of the field where the speed of fluid shows uniform distribution by Ua1 becomes small.

On the other hand, between the main jet stream and an annular jet stream, it or in the shearing force which arose by the velocity differential, and the mixed effect of fluid occurs.

By this, fluid A to be conveyed is diffused on the radius outside, and fluid B is gradually diffused in a radius inner side.

Since the velocity differential in the boundary part of both fluid will become small if diffusion of fluid progresses, the mixed effect of the fluid which arises by a velocity differential also becomes small.

Diffusion of both fluid is controlled to some extent as the result, and the state where the width (width between dashed line E-E') of a diffusion region is small can be maintained.

Control of this diffusion continues until diffusion of the radius outside of fluid B progresses.

When fluid A to be conveyed is made into the main jet stream and it is made to blow off from the above result in fluid C on condition of velocity ratio Ua/Um<=1 of both jet streams by making fluid B into an annular jet stream by a double nozzle, fluid B shows the same effect as an air curtain until diffusion of fluid B progresses.

Therefore, diffusion of fluid A to be conveyed is controlled.

The range which diffuses fluid A to be conveyed as compared with the case where it is made to blow off as a laminar flow jet stream is controlled.

Fluid B and fluid C can acquire similarly the effect of diffusion control of fluid A shown above to be conveyed, even when homogeneous.

Fluid A to be conveyed and fluid B can acquire the above effect similarly, even when homogeneous.

[In the Case of 1<Ua/Um<=2]

Drawing 25 shows the state where it blew off from the 1st exhaust nozzle 31 of double nozzle 30 considering fluid A to be conveyed as a main jet stream (laminar flow jet stream) of section average speed Um.

Drawing 25 shows the state where it blew off from the 2nd exhaust nozzle 32 considering fluid B as the 2nd fluid as an annular jet stream of section average speed Ua.

Drawing 25 is an explanatory view showing change of the speed distribution to distance Z from the 1st and 2nd exhaust nozzle 31 and 32 at the time of making it blow off in fluid C on condition of velocity ratio 1<Ua/Um<=2 of both jet streams.

As shown in Drawing 25, the shape of speed distribution of the main jet stream in the 1st and 2nd exhaust nozzle 31 and 32 (Z=0) of double nozzle 30 and an annular jet stream resembles the case of Ua/Um<=1, if the difference in the value of speed is removed.

Speed distribution of the main jet stream (fluid A to be conveyed) turns into uniform distribution of speed Um1 in 0<=r<=Dm/2.

r>Dm/2 show the distribution which speed becomes small rapidly in slight width (between dashed line D-D' in a figure), and is set to 0, and the shape shows the shape near rectangular form (cylindrical in three dimensions) by it.

Similarly, speed distribution of an annular jet stream (fluid B) also turns into uniform distribution of speed Ua1 in Dm/2<r<=Da/2.

r>Da/2 show the distribution which speed becomes small rapidly in slight width, and is set to 0.

The shape of distribution shows the shape near rectangular form (three dimensions show the shape of a pillar which pierced through the range of r<Dm/2).

At this time, also on the conditions of this velocity ratio, it originates in the shearing force which arose by the velocity differential like the case of a laminar flow jet stream, and the mixed effect of fluid occurs, according to this effect, fluid B is diffused on the radius outside and fluid C is diffused in a radius inner side on the radius outside (boundary part of fluid B and fluid C) of an annular jet stream.

This mixed effect advances gradually as it progresses in the direction of the lower stream.

Thereby, the speed of fluid B falls gradually from the radius outside, and the speed of fluid C increases gradually on the contrary.

As this result, the width (width between dashed line E'-F) of the field which mixture of fluid has produced spreads, and the width of the field where speed shows the uniform distribution of Ua1 becomes small.

On the other hand, between the main jet stream and an annular jet stream, it originates in the shearing force which arose by the velocity differential too, and the mixed effect of fluid occurs, by this, fluid A to be conveyed is diffused on the radius outside, and fluid B is gradually diffused in a radius inner side.

However, there are more amounts of diffusion of fluid A on the conditions of this velocity ratio to be conveyed than the case of Ua/Um<=1.

This reason is because the quantity which draws fluid A to be conveyed when the direction of the speed of fluid B became high, i.e., the quantity of fluid A which is pulled by high-speed fluid B and flows into fluid B to be conveyed, increased.

And diffusion of fluid progresses and the velocity differential in the boundary part of fluid A to be conveyed and fluid B becomes small as the position of the direction of the lower stream separates from the 1st and 2nd exhaust nozzle 31 and 32.

Therefore, the mixed effect of the fluid which arises by a velocity differential also becomes small.

As a result, diffusion of fluid A to be conveyed and fluid B is controlled to some extent, and a spread (spread of the width between dashed line E-E') of the radial direction of a diffusion region can be suppressed.

However, the width of a diffusion region is wider than the case of Ua/Um<=1.

Control of this diffusion continues until diffusion of the radius outside of fluid B progresses.

By a double nozzle, let fluid A to be conveyed be the main jet stream, and let fluid B be an annular jet stream.

The above and both jet streams are made to blow off in fluid C on condition of velocity ratio 1<Ua/Um<=2.

Then, diffusion of fluid A to be conveyed is controlled by the same effect as the air curtain obtained by fluid B.

Therefore, the range which diffuses fluid A to be conveyed compared with the case where it is made to blow off as a laminar flow jet stream can be controlled.

However, the amount of diffusion of fluid A to be conveyed becomes larger than the case of Ua/Um<=1.

Fluid B and fluid C can acquire similarly the effect of diffusion control of fluid A shown above to be conveyed, even when homogeneous.

Fluid A to be conveyed and fluid B can obtain similarly, even when homogeneous.

[In the Case of 2<Ua/Um]

The shape of speed distribution of the main jet stream in the 1st and 2nd exhaust nozzle 31 and 32 (Z=0) and an annular jet stream resembles the case of Ua/Um<=1 except the difference in the value of speed.

However, on this condition, the effect of diffusion of fluid B which arises on the radius outside of an annular jet stream becomes high.

The effect of diffusion of fluid A which arises between the main jet stream and an annular jet stream to be conveyed, and fluid B becomes very high.

For this reason, fluid A to be conveyed is diffused quickly in the position near downstream 1-2D of the 1st exhaust nozzle 31.

EXAMPLE

About the fluid conveying machine and fluid transportation method of the present invention, evaluation using the following three numeric simulations was performed.

(1) A break through of the conditions for carrying out continuously forming of the optimal vortex ring for transportation by a pulsating jet stream.

(2) The elucidation of the technique for storing heat fluid effectively into a vortex ring.

(3) Evaluation of the transport capacity of the heat fluid which a vortex ring has.

In this example, since the numeric simulation was used as a means of examination, verification about the validity of this simulation result was carried out in advance of examination of each examination item.

In the result shown below, the verification result of a numerical simulation is shown first and the examination result of each item is shown after that.

(1) Verification of the Validity of a Numerical-Simulation Result

It verified about the validity of the calculation technique, calculation code and calculation lattice model which were used by this examination, and calculation conditions.

Verification was performed by comparing an analysis result with an experimental result, using underwater vortex ring formation as a candidate for verification.

[The Method of a Numeric Simulation]

The outline of two kinds of lattice models ("all the circumferential models" and an "axial symmetry model" are called hereafter.) which used the setting conditions about calculation for calculation in Table 1 was shown in Drawing 11A-Drawing 11C.

Drawing 11A is an axial symmetry model figure.

Drawing 11B is all the circumferential model figures.

Drawing 11C is a nozzle part enlarged drawing of all the circumferential models.

The analysis field assumes the flow place which makes a jet stream blow off from a nozzle periodically toward large space, and has set it up according to experiment environment.

[Table 1]

| Item | Method Adopted |
|---|---|
| Fundamental Equations | Equation of continuity<br>Three-dimensional Navier-Stokes equation<br>Energy equation (used along with the aforementioned equations only during heat transportation analysis) |
| Calculation Scheme | Space: Finite volume method (hexahedron cell)<br>Time: Secondary accuracy backward implicit method<br>Convection term: Central differential method |
| Turbulence Model | Large Eddy simulation<br>SGS model is a dynamic Smagorinsky model |

All the circumferential models are three-dimensional lattice models which reproduced faithfully the field made applicable to analysis.

This model has set up the surface imagery of a calculation lattice highly in consideration of implementation of turbulent flow analysis.

Thereby, the action change from formation of a vortex ring to diffusion can be simulated in detail.

On the other hand, the model for an axis is a lattice model which used only one fourth of the fields of all the circumferential models.

This model makes it possible to analyze a three-dimensional flow place for a short time by imposing a periodic boundary condition on a cutting plane (equivalent to imposing axial symmetry conditions on a flow place).

[About the Pulsating Conditions of a Jet Stream]

The waveform of flow change of a pulsating jet stream is taken as the sine wave form shown in Drawing 12.

In this case, velocity amplitude V0 and cycle T showing the conditions of flow change serve as formation conditions of a vortex ring.

The non-dimension parameter which is shown in the notation of conditions with the following formula using diameter dn of the exhaust nozzle in addition to above-mentioned V0 and T is used.

[Equation 1]

Amplitude Reynolds number:

$$\mathrm{Re}_o = \frac{V_0 d_n}{\nu}, \tag{1}$$

Womersley number:

$$\frac{d_n}{2}\sqrt{\frac{2\pi}{\nu T}} \tag{2}$$

Strouhal number:

$$Str = \frac{d_n}{V_0 T} \tag{3}$$

[A Check of the Formation Process of the Vortex Ring by an Experimental Result]

Drawing 13A-Drawing 13C are figures showing the formation process of the underwater vortex ring (a "water vortex ring" is called hereafter.) which used non-dimension whirlpool degree distribution.

Drawing 13A-Drawing 13C are shown using the experimental result and the calculation result by two lattice models about phase change of the formation process of the vortex ring in one cycle of flow change.

Drawing 13A is an experimental result figure.

Drawing 13B is a figure as a result of being based on all the circumferential models.

Drawing 13C is a figure as a result of being based on an axial symmetry model.

The contour of the figure shows distribution of the degree of whirlpool equivalent to the rotation angle speed of a local domain.

The arrow in a figure shows the vertical hand of cut, and it expresses that rotation is so quick that it is deep-colored.

The formation process of a vortex ring is checked from the experimental result of Drawing 13A.

Vortex ring V1 used for transportation is formed when wound by vorticity layer S1 which shows the boundary layer which the jet stream breathed out and was formed on the wall surface in a nozzle in the period at the exit of a nozzle.

On the other hand, in the suction period of a nozzle, it inhales and boundary layer S2 is formed on the wall surface in a nozzle of a flow.

This boundary layer S2 exfoliates from a wall surface soon, and forms exfoliation vortex ring VS2.

VS2 moves to a nozzle exhaust nozzle as a jet stream changes to breathing out from suction.

VS2 interferes with V1 in the middle of formation.

From this, it can be predicted that the influence of VS2 given to the strength (circulation of a vortex ring) of the whirlpool of V1 is very great.

[The Verification Result of Numeric Simulation]

The result (Drawing 13B, Drawing 13C) of a numeric simulation ("CFD (Computational Fluid Dynamics)" is called hereafter.) is checked about the formation process of the vortex ring shown above.

As a result, it turns out that it is hard to diffuse VS2 compared with an experimental result.

The result is the same also as all the circumferential models and an axial symmetry model.

And the time in which VS2 has interfered with V1 is long.

By the result of an axial symmetry model, it can check especially that this tendency appears strongly.

By this CFD, the strength (circulation) of V1 has estimated this too little.

The estimated degree means that the direction of an axial symmetry model becomes large.

With the other point, the experimental result and the simulation are well in agreement, and are considered that it can fully evaluate a qualitative action change of V1.

Drawing 14A and Drawing 14B show phase-angle change of the vortex ring attainment position (center position of a vortex ring cross section), and the vortex ring diameter.

The CFD result denoted by the symbol of the experimental result denoted by the black-lacquered symbol and white is well in agreement, and quantitive evaluation is possible for it about the action and size of a vortex ring.

From the above result, in this simulation, the strength of a vortex ring is weaker than the actual condition, and may estimate.

About the formation process of a vortex ring, a qualitative evaluation is possible, and a quantitative evaluation is also possible about the action and size of a vortex ring.

(2) The Vortex Ring Optimal in Order to Carry Out Continuously Forming of the Optimal Vortex Ring for Transportation by a Pulsating Jet Stream is as Follows.

That is, it is a vortex ring with large and volume (capacity which stores a transportation thing) of a vortex ring, and a large (time is required by diffusion) value of circulation showing the strength of a vortex ring.

Therefore, in order to clarify the formation conditions of the optimal vortex ring for heat transport, it is necessary to clarify about a relation with the volume of a vortex ring (an "air vortex ring" is called hereafter), and the circulation and the pulsating conditions of a jet stream which are formed in the air.

According to the experimental result of the vortex ring (water vortex ring) formation by underwater [ which was mentioned above], it became clear that the volume of a vortex ring and circulation had a relation of direct proportion.

Circulation of the vortex ring could be expressed using Strouhal number Str (refer to formula (2).) of a pulsating jet stream, and it also became clear that circulation served as the maximum on condition of Str≈0.05.

It is assumed that these experimental results are similarly materialized to the formation process of an air vortex ring.

That is, if hydrodynamic similarity is checked about vortex ring formation, all the knowledge acquired in the experiment of the water vortex ring can be applied also to an air vortex ring.

So, in this embodiment, after checking the existence of the hydrodynamic similarity about vortex ring formation, examination about the optimal formation conditions of an air vortex ring was performed.

Examination followed the following three pulsating conditions that circulation included the conditions used as the maximum by a water vortex ring.

Condition A: Re 0=2350, alpha=23.3, Str=0.146

Condition B: Re 0=4473, alpha=19.3, Str=0.053

Condition C: Re 0=5926, alpha=19.3, Str=0.040

[The Formation Process of the Vortex Ring in the Air]

Phase-angle change of the air vortex ring on the pulsating conditions of conditions A is shown in Drawing 15A using non-dimension vorticity distribution.

All the circumferential models were used in this CFD.

The CFD result using the axial symmetry model of the water vortex ring on the same pulsating conditions is also shown in Drawing 15B for comparison.

From Drawing 15A and Drawing 15B, both are very well in agreement in the action change from formation of vortex ring [which is used for transportation] V1, and exfoliation vortex ring VS2 to diffusion.

The difference from which diffusion takes time to the direction of a water vortex ring in the diffusion process of VS2, and a difference slight to the sectional shape of vortex ring V1 are seen.

This can be judged not to be what is depended on the difference in the lattice model used by calculation, and is depended on the difference in the physical properties of a working fluid from the verification result of the simulation mentioned above.

Coincidence of the formation process of the air vortex ring shown above and a water vortex ring was similarly checked on conditions B and C.

In (a figure is an abbreviation) and the formation process of the vortex ring, it was checked from this that hydrodynamic similarity is materialized.

[Relation between the Strength of a Vortex Ring, and the Pulsating Conditions of a Jet Stream]

The result obtained from an experiment and CFD is shown in Drawing 16 about the relation between non-dimension circulation of a vortex ring, and the Strouhal number (Str) of a pulsating jet stream.

in this figure, that the value of non-dimension circulation Re gamma/Re 0 changes with Str(s) means that circulation Regamma of a vortex ring changes, if cycles T differ also with the value with amplitude Re0 [same] of a pulsating jet stream, and Str(s) differ namely.

From the value (green symbol) of the estimate equation established based on an experimental value (0 in a figure) and an experimental result, and whirlpool theory, when Str is made small, after non-dimension circulation of a water vortex ring increases and serves as the maximum on condition of Str≈0.05, it shows change which decreases rapidly.

This shows that the vortex ring (namely, the optimal vortex ring for transportation) which circulation does not diffuse greatly is formed on condition of the following.

The velocity amplitude of the condition is Str≈0.05.

The pulsating conditions of cycle T of the condition are V0.

As for the CFD result (black dot in a figure) of the water vortex ring, non-dimension circulation shows the small value compared with the experimental value also in any of conditions A, B, and C.

As this reason, since the axial symmetry model is used in this CFD, on all the pulsating conditions, it is harder to diffuse an exfoliation vortex ring than the actual condition.

It is thought that the time in which the exfoliation vortex ring has interfered with the vortex ring as the result became long, and circulation of the vortex ring became small.

All of conditions A, B, and C of the pace of decrease to the experimental value of the value of non-dimension circulation are almost the same.

It turns out that the rate of change of non-dimension circulation to Str is in agreement with an experimental result, and it can check also by CFD which used the axial symmetry model about the conditions from which the non-dimension circulation obtained by experiment serves as the maximum.

According to the CFD result (dot of the diamond type in a figure) of an air vortex ring, the non-dimension circulation on conditions A shows the small value compared with the experimental value, and shows the almost same value as the value of a water vortex ring.

This reason is the same as the case of CFD of a water vortex ring, and even when all the circumferential models are used, an exfoliation vortex ring results in actually not diffusing lay easily, either.

It is thought that circulation of the vortex ring became small by this.

On the other hand, in conditions B and C, non-dimension circulation differs from the result of the water vortex ring greatly, and shows the almost same value as an experimental value.

The following things can be considered as this reason.

Drawing 17A and Drawing 17B show the non-dimension vorticity distribution on conditions B.

The length (the direction of a flow) of exfoliation boundary layer S2 formed during the suction of a jet stream on this pulsating condition is longer than the length in the case of conditions A (refer to Drawing 15.).

Drawing 15 shows that exfoliation boundary layer S2 is extended in the direction of the upper stream.

Thus, when the length of an exfoliation boundary layer is extended, vorticity layers cannot gather in one field easily.

Therefore, exfoliation vortex ring VS2 which has a big cross-section field like conditions A becomes that it is hard to be formed.

For this reason, an exfoliation vortex ring will be in the state of being easy to be spread.

Since axial symmetry conditions are not imposed in calculation, the influence of the exfoliation vortex ring which diffusion of an exfoliation vortex ring further follows and is exerted on formation of a vortex ring becomes small.

For this reason, it is thought that circulation of the vortex ring became large as a result.

The tendency of change of the non-dimension circulation to Str is in agreement with an experimental result.

Non-dimension circulation of an air vortex ring serves as the maximum on condition of Str≈0.05 like the case of a water vortex ring.

This result shows that hydrodynamic similarity is materialized also in circulation (strength of a vortex ring) of a vortex ring.

From the above result, if condition Re0 of a pulsating jet stream, alpha, and Str are the same, no matter the physical properties of fluid may be what things, the formation process of a vortex ring and circulation will become the same.

Therefore, hydrodynamic similarity's being materialized and circulation of a vortex ring serve as the maximum on condition of Str≈0.05.

The formation conditions of the vortex ring optimal from this for transportation are Str≈0.05.

(3) A Break Through of the Conditions for Storing Heat Fluid Effectively into a Vortex Ring.

In order to realize intensive transportation within partial space which is heat fluid, it is necessary to store heat fluid in a vortex ring.

As Drawing 13, Drawing 15, and Drawing 17 showed, a vortex ring is formed when wound by boundary layer S1 formed on the wall surface in a nozzle during the disorption of a jet stream at the exit of a nozzle.

Therefore, in order to store heat fluid in a vortex ring, the method of pouring it in directly into S1 rather than making heat fluid blow off as a pulsating jet stream is effective.

This example examined the effective method for storing heat fluid in a vortex ring.

[The Examination Conditions of a Storing Method]

Examination of the storing method was done to the following four methods (a schematic diagram is shown in Drawing 18A-Drawing 18C.).

Method 1: When heat fluid is made to blow off as a pulsating jet stream (not shown) (simplest method)

Method 2: How (refer to FIG. 18A.) to establish a heat source on the wall surface in a nozzle, and to heat a boundary layer Method 3: How (refer to FIG. 18B.) to install a heat source on the wall surface of the inner side of a nozzle, and the outside, and to heat a boundary layer Method 4: How (movement of heat fluid is caused by the pressure difference which arises by flow around a channel exit) (refer to FIG. 18C.) to establish a 0.5-mm-wide channel in the wall surface in a nozzle, and to inject heat fluid into it automatically into a boundary layer In order that one primitive equation which is used unlike the calculation performed so far may increase, calculation of the simulation of heat fluid will take about 3 times in the case of an air vortex ring as many computation time, by the time it obtains a result.

For this reason, examination was performed about the case where it is the water vortex ring which had an experiment track record in the start stage of this research, and the axial symmetry model was used for calculation.

The conditions of the flow place used for examination are as follows.

The vortex ring which formed underwater [underwater water temperature is 20° C.]on the pulsating conditions of Str=0.053 conveys 80° C. water into specific space.

Since the effect of molecular diffusion becomes strong compared with conveyance of chilled water, the evaluation of the transport capacity under the severest transportation condition of transportation of hot water is attained.

[The Examination Result of the Storing Method of Heat Fluid]

The transportation result of the heat fluid in four methods is shown in Drawing 19A-Drawing 19D using temperature distribution.

Method 1 shown in Drawing 19A

The result of a conventional example shows that heat fluid is hardly stored in a vortex ring, and intensive transportation within partial space cannot be performed by this method.

The whole inside of a nozzle is making pulsation start in this method from the state currently fulfilled by the hot water which is 80° C.

Therefore, although heat fluid is stored in a vortex ring the 1st cycle of pulsation, heat fluid does not flow in a boundary layer after the 2nd cycle.

For this reason, heat fluid is not stored in a vortex ring.

According to the result of method 2 shown in Drawing 19B, the fluid in a boundary layer is heated by the heat source of the wall surface in a nozzle.

Therefore, hot water is stored in a vortex ring and it turns out that the intensive transportation within partial space is possible.

However, the temperature of the hot water in a vortex ring is immediately after vortex ring formation, and is about 25° C. also in the vortex ring central point where temperature is the highest.

This has about 31% of the temperature of the source of heating, and cannot be said to be effectively storable [heat fluid].

The heating value stored into a vortex ring is greatly dependent on the coefficient of heat-transfer of fluid.

Therefore, it is thought that it is not suitable to air with a small coefficient of heat-transfer.

According to the result of method 3 shown in Drawing 19C, the fluid heated by this heat source flows into a nozzle by having expanded the heat source even to the wall surface of the outside of a nozzle at the time of suction of a jet stream.

Therefore, it increases from the case where the heating value which flows in a boundary layer is method 2.

As a result, the temperature of the vortex ring central point rose by about 5° C.

However, the heating value in which this method is also stored cannot be said to be the optimal storing method from it being greatly dependent on the coefficient of heat-transfer of fluid.

According to the result of method 4 shown in Drawing 19D, by this method, 80° C. hot water flows into a boundary layer directly.

Therefore, it is surmised that it is the most effective method.

The heat fluid which flowed into the boundary layer is taken in into the vortex ring, and it can check that intensive transportation to the partial space of heat fluid is possible.

The temperature of the vortex ring central point immediately after vortex ring formation is about 30° C., and brought the almost same result as the case of method 3.

In terms of the channel width, the volume of the heat fluid flowing from the flow path into the boundary layer was too small with respect to the volume of the vortex ring.

Therefore, the heat fluid taken in into the vortex ring will be diffused immediately, and temperature will fall rapidly.

However, about this point, it is improvable by making the volume of the heat fluid which expands width and into which it makes it flow increase.

The temperature distribution of the heat fluid at the time of blowing off heat fluid by a fixed flow as reference (namely, the general jet method) is shown in Drawing 19E.

Water temperature is falling as it separates from a nozzle according to mixture and the diffusion effect of a flow.

Therefore, it turns out that intensive transportation within partial space as shown in methods 2, 3, and 4 cannot be performed.

From the above result, the method 4 (a method of pouring in heat fluid automatically into a boundary layer from the channel established in the wall surface in a nozzle) is the most effective as a method of storing heat fluid into a vortex ring.

About methods 2 and 3, although an effect is inferior to method 4, heat fluid is storable in a vortex ring.

Therefore, as compared with method 1, it turns out that it is effective.

(4) Evaluation of the Transport Capacity of the Heat Fluid which a Vortex Ring Has The transport capacity of the vortex ring at the time of using method 4 was evaluated.

This method 4 is a method judged to be the most effective by examination of the above-mentioned storing method.

The conditions of a flow place are the same as the conditions used by examination of the storing method.

The vortex ring formed on the pulsating conditions of Str=0.053 by underwater [underwater water temperature is 20° C.] was used.

The case where intensive transportation of the 80° C. hot water is carried out by a vortex ring at partial space is assumed.

Evaluation of transport capacity was performed also about the case where width of a channel is 0.5 mm and that of 1.5 mm, that is shown in Drawing 19D.

The axial symmetry model is used in this simulation.

[The Evaluation Result of the Transport Capacity of Heat Fluid]

The relation of the temperature of the vortex ring central point and the attainment position of the central point in each width is shown in Drawing 20:

According to the result of 0.5 mm in a width of a channel, the temperature of the center of a vortex ring was 40° C. when a vortex ring was formed.

The temperature has fallen rapidly to 30° C., immediately after a vortex ring separates from a nozzle.

Thereby, it turns out that diffusion of heat fluid progressed rapidly.

After this, diffusion progresses gently.

Since the temperature in the vortex ring in the time of starting transportation is not high, in the position of 4d (4 times of nozzle diameter d) at which the vortex ring arrived, the temperature of the center of a vortex ring is the almost same temperature as the surrounding water temperature.

According to the result of 1.5 mm in a width of a channel, the temperature of the center of a vortex ring has fallen rapidly [immediately after a vortex ring separates from a nozzle] even in this case.

Thereby, it turns out that diffusion of heat fluid progressed rapidly.

However, the temperature of the vortex ring central point shows the value higher than the case of 0.5 mm by having made the volume of the heat fluid which expands a width of a channel and flows into a vortex ring increase.

The temperature of the center of a vortex ring is maintaining about 56% of temperature of 45° C. and a heat source also in the position whose position at which the vortex ring arrived is 4d.

The temperature of the central point of the vortex ring in the width of this channel was 35.5° C. (about 44% of a heat source) in the position whose attainment position is 10d.

In the position whose attainment position of a vortex ring is 20d, it was 22.5° C. (about 28% of a heat source).

Since the axial symmetry model is used in this simulation, circulation of the vortex ring has estimated smaller than the actual condition.

Therefore, it is thought that the actual transport capacity of a vortex ring is higher than the above-mentioned result.

The transport capacity of the air vortex ring was presumed as follows based on the evaluation result of the heat transporting ability of the water vortex ring shown above.

The effect of diffusion of an air vortex ring is as large as about 10 times of the vortex ring of water.

Therefore, the transport capacity of an air vortex ring falls in 1/10 of the vortex rings of water.

However, the movement speed of an air vortex ring is dramatically as quick as about 20 to 30 times of the movement speed of the water vortex ring with same pulsating conditions, and the reaching distance is extended.

From these things, it is thought that the transport capacity of an air vortex ring becomes about 2 to 3 times higher than a water vortex ring (Drawing 20).

That is, the temperature of the central point of the vortex ring in an air vortex ring when a width of a channel is 1.5 mm is about (44.5° C. of temperature falls) 35.5° C., in attainment position in 20d.

The attainment position of a vortex ring is conjectured that the temperature of the center of a vortex ring is about (57.5° C. of temperature falls) 22.5° C. at 40d.

INDUSTRIAL APPLICABILITY

The fluid transportation device and the fluid transportation method of the present invention can be used within [in large space or pipeline, or a duct etc.] the closed space.

It can use as a transportation means of the fluid of a different kind or of the same kind in the fluid filled in such space.

It is possible to use as the transportation means of the gas of a different kind or of the same kind in gas or a transportation means of the gas in a fluid.

The following is mentioned as a concrete use use.

(1) Use as a blowing method of for home use and business-use air-conditioning equipment.

(2) Use as a blowing method of in-vehicle air-conditioning equipment.

(3) Use as a concentration cooling method of the electron device in a personal computer, a large-sized server, and IT apparatus.

(4) Use as a blowing method of various for home use and business-use air cleaning devices (5) Use as a concentration cooling method of the electron device in a household appliance article, operating apparatus, and OA equipment.

(6) Use as a means of the carry heat at the time of using for the warmth of a catalyst the exhaust heat discharged in a hybrid vehicle.

Since combustor efficiency of a hybrid car is good, there is little engine exhaust heat.

Therefore, such a means is called for.

(7) Use as a transportation means of the exhaust heat at the time of using the exhaust heat collected from the exhaust gas by the hybrid vehicle as the warmth of an engine and its peripheral device, or heating in the car.

(8) Use as an air curtain in the freezer entrance of a refrigerator car.

(9) Use as an air curtain in the freezer entrance of a factory.

(10) Use as a transportation method for sending oxygen at the time of oxygen suction to a patient's mouth and nose in clinical practice, without using an oxygen mask.

(11) Use as a transportation method for sending the medicine of gas, such as anesthetic gas, to a patient's mouth and nose in clinical practice, without using a mask.

(12) Use as a transportation method for sending warmth to a patient for the object of body temperature maintenance of the patient under operation in clinical practice.

(13) Use as a transportation method of oxygen for protecting the doctor who is an operator in clinical practice from the gas which occurs during an operation.

(14) Use as a transportation method for sending oxygen to a passenger's mouth and nose in an airplane, without using an oxygen mask for an emergency.

(15) Use as a method of conveying warmth and cold for the worker in a factory.

(16) Use as a method of promoting diffusion of an antiseptic article within the sewage purifier of water works.

(17) Use as the warmth aiming at the growth promotion of the plant in Green House, and a high concentration conveying method of CO2.

(18) Use as a transportation method of the medicine for controlling the chemical reaction speed and concentration in a reactor locally at a chemical plant factory.

(19) Use as a transportation method of the minute particle group in gas and a fluid.

What is claimed is:

1. A fluid conveying device comprising:

a tubular spurting part having a central interior space, which is surrounded by an inner tubular surface of the tubular spurting part, and through which a conveyance fluid is conveyed, a first nozzle opening to discharge the conveyance fluid out of the central interior space and out of the spurting part, and at least one internal exhaust nozzle each having an internal nozzle opening that is located inside the tubular spurting part, is located at the inner tubular surface or at a radially outer region of the central interior space, is located at a distance upstream from a rim of the first nozzle opening, is aimed in a direction at least partially toward the first nozzle opening, and is configured to discharge a second fluid out of the internal nozzle opening and into the central interior space such that the second fluid is subsequently discharged out of the first exhaust opening together with the conveyance fluid, the fluid conveying device configured to form a vortex ring by blowing the conveyance fluid out of the first nozzle opening into space, and blow the second fluid out of the internal nozzle opening and to a radially outer region of the conveyance fluid at a speed lower than a speed of the center of the conveyance fluid.

2. The fluid conveying device according to claim 1, wherein the spurting part has a wall around the central interior space, and terminating at the first nozzle opening, and the wall has an internal channel through which the second fluid is conveyed to the internal nozzle opening.

3. The fluid conveying device according to claim 1, further comprising:

a source of heating or a source of cooling to heat or cool the conveyance fluid when the conveyance fluid is within the spurting part.

4. A fluid transportation method comprising, by using a tubular spurting part having a central interior space, which is surrounded by an inner tubular surface of the tubular spurting part and through which a conveyance fluid is conveyed, a first nozzle opening to discharge the conveyance fluid out of the central interior space and out of the spurting part, and at least one internal exhaust nozzle each having an internal nozzle opening that is located inside the tubular spurting part, is located at the inner tubular surface or at a radially outer region of the central interior space, is located at a distance upstream from a rim of the first nozzle opening, is aimed in a direction at least partially toward the first nozzle opening, and is configured to discharge a second fluid out of the internal nozzle opening and into the central interior space such that the second fluid is subsequently discharged out of the first exhaust opening together with the conveyance fluid:

blowing the conveyance fluid out of the first nozzle opening to form a vortex ring; and, concurrently, blowing the second fluid out of the internal nozzle opening, such that the second fluid is supplied to a radially outer region of the conveyance fluid at a speed lower than the speed of the center of the conveyance fluid.

5. A fluid conveying device comprising:

a tubular coaxial double nozzle having an inner tubular surface and an outer tubular surface, a central interior space surrounded by the inner tubular surface and through which a first fluid is conveyed, a first nozzle opening, at an end of the inner tubular surface, that spouts a first fluid as a laminar flow jet stream, an annular outer channel, located in a tubular structure between the inner tubular surface and the outer tubular surface of the coaxial double nozzle, to convey a second fluid, and an annular second nozzle opening located at an end of the annular outer channel, surrounding around the first nozzle opening, aimed in a direction parallel to a central axis of the central interior space, configured to spout a second fluid as an annular jet stream, and having an opening width that is ½ or less width of a diameter of the first nozzle opening, the fluid conveying device configured to blow the first fluid through the central interior space and concurrently blow the second fluid through the annular outer channel.

6. The fluid conveying device according to claim 5, wherein the fluid conveying device spouts the first fluid at a velocity Um and spouts the second fluid at a velocity Ua, and Um and Ua satisfy $0.25 <= Ua/Um <= 2$.

7. The fluid conveying device according to claim 5, wherein a Reynolds number of the first fluid is larger than zero, and is 2000 or less.

8. The fluid conveying device according to claim 6, wherein the Reynolds number is larger than zero, and is 2000 or less.

9. The fluid conveying device according to claim 5, configured to maintain the first fluid in the annular jet stream for a distance of 50 cm or more.

10. The fluid conveying device according to claim 6, configured to maintain the first fluid in the annular jet stream for a distance of 50 cm or more.

11. The fluid conveying device according to claim 7, configured to maintain the first fluid in the annular jet stream for a distance of 50 cm or more.

12. The fluid conveying device according to claim 8, configured to maintain the first fluid in the annular jet stream for a distance of 50 cm or more.

13. A fluid transportation method comprising, by using tubular coaxial double nozzle having an inner tubular surface and an outer tubular surface, a central interior space surrounded by the inner tubular surface and through which a first fluid is conveyed, a first nozzle opening, at an end of the inner tubular surface, that spouts a first fluid as a laminar flow jet stream, an annular outer channel, located in a tubular structure between the inner tubular surface and the outer tubular surface of the tubular coaxial double nozzle, to convey a second fluid, and an annular second nozzle opening located at an end of the annular outer channel, surrounding around the first nozzle opening, aimed in a direction parallel to a central axis of the central interior space, configured to spout a second fluid as an annular jet stream, and having an opening width that is ½ or less width of a diameter of the first nozzle opening:

blowing the first fluid through the central interior space and concurrently blowing the second fluid through the annular outer channel; and spouting the second fluid as the annular jet stream from the annular second nozzle opening while concurrently spouting the first fluid as the laminar flow jet stream from the first nozzle opening.

14. The fluid conveying device according to claim 1, wherein the at least one internal exhaust nozzle is at the inner tubular surface.

15. The fluid conveying device according to claim 1, wherein the at least one internal exhaust nozzle is at the radially outer region of the central interior space.

16. The fluid conveying device according to claim 15, wherein the at least one internal exhaust nozzle is disposed as a plurality of internal exhaust nozzles, and the plurality of internal exhaust nozzles are disposed at intervals around a central axis of the central interior space.

* * * * *